US008182289B2

(12) United States Patent
Stokoe et al.

(10) Patent No.: US 8,182,289 B2
(45) Date of Patent: May 22, 2012

(54) HIGH DENSITY ELECTRICAL CONNECTOR WITH VARIABLE INSERTION AND RETENTION FORCE

(75) Inventors: Philip T. Stokoe, Attleboro, MA (US); Mark W. Gailus, Concord, MA (US); Donald A. Girard, Jr., Bedford, NH (US); Huilin Ren, Amherst, NH (US)

(73) Assignee: Amphenol Corporation, Wallingford Center, CT (US)

( * ) Notice: Subject to any disclaimer, the term of this patent is extended or adjusted under 35 U.S.C. 154(b) by 0 days.

(21) Appl. No.: 13/070,343

(22) Filed: Mar. 23, 2011

(65) Prior Publication Data

US 2011/0212649 A1 Sep. 1, 2011

Related U.S. Application Data

(63) Continuation of application No. PCT/US2009/005275, filed on Sep. 23, 2009.

(60) Provisional application No. 61/099,369, filed on Sep. 23, 2008.

(51) Int. Cl.
*H01R 13/648* (2006.01)

(52) U.S. Cl. ..... 439/607.11; 439/607.07

(58) Field of Classification Search ..... 439/79, 439/108, 607.02, 607.11, 607.09, 607.07, 439/701

See application file for complete search history.

(56) References Cited

U.S. PATENT DOCUMENTS

| | | | | |
|---|---|---|---|---|
| 5,947,754 | A | 9/1999 | Lin | |
| 6,379,188 | B1 * | 4/2002 | Cohen et al. | 439/607.07 |
| 6,739,918 | B2 * | 5/2004 | Cohen et al. | 439/701 |
| 6,780,059 | B1 | 8/2004 | Payne et al. | |
| 7,101,188 | B1 | 9/2006 | Summers et al. | |
| 2004/0018757 | A1 | 1/2004 | Lang et al. | |
| 2005/0095919 | A1 | 5/2005 | Aekins et al. | |
| 2005/0266728 | A1 | 12/2005 | Houtz | |

FOREIGN PATENT DOCUMENTS

| | | | |
|---|---|---|---|
| EP | 0905826 | A2 | 3/1991 |
| EP | 1783871 | A1 | 5/2007 |

* cited by examiner

*Primary Examiner* — Javaid Nasri
(74) *Attorney, Agent, or Firm* — Wolf, Greenfield & Sacks, P.C.

(57) ABSTRACT

An interconnection system that includes a daughter card and backplane electrical connectors mounted to printed circuit boards at connector footprints. The spring rate of beam-shaped contacts in the daughter card connector increases while mating with the backplane connector so that the retention force may be greater than the insertion force. Such a change in spring rate may be achieved by positioning the beam-shaped contacts adjacent a surface of a connector housing. That surface may include a projection that aligns with the beam-shaped contact. When the connectors are unmated, the beam-shaped contact may be spaced from the projection. As the connectors begin to mate, a central portion of the beam-shaped contact may be pressed against the projection, which has the effect of shortening the beam length and increasing its stiffness.

25 Claims, 17 Drawing Sheets

HIGH DENSITY ELECTRICAL CONNECTOR WITH VARIABLE INSERTION AND RETENTION FORCE

RELATED APPLICATIONS

This application is a continuation of PCT Application PCT/US2009/005275, filed Sep. 23, 2009 which claims priority to U.S. Provisional Application 61/099,369, filed Sep. 23, 2008 which are incorporated herein in their entireties.

BACKGROUND

This invention relates generally to electrical interconnections for connecting printed circuit boards.

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Electronic systems have generally become smaller, faster and functionally more complex. These changes mean that the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

As signal frequencies increase, a greater possibility exists for electrical noise to be generated in the connector in forms such as reflections, cross-talk and electromagnetic radiation. Therefore, electrical connectors are designed to control cross-talk between different signal paths, and to control the electrical properties of each signal path. In order to reduce signal reflections in a conventional connector module, the impedance of each signal path is controlled to avoid abrupt changes of impedance that can cause signal reflections. The impedance of a signal path is generally controlled by varying the distance between a conductor carrying the signal path and adjacent conductors, the cross-sectional dimensions of the signal conductor, and the effective dielectric constant of materials surrounding the signal conductor.

Cross-talk between distinct signal paths can be controlled through the use of shielding. Signal paths may be arranged so that they are spaced further from each other and nearer to a shield, which may be implemented as a grounded metal plate. The signal paths tend to electromagnetically couple more to the ground conductor, and less with each other. For a given level of cross-talk, the signal paths can be placed closer together when sufficient electromagnetic coupling to the ground conductors are maintained.

Electrical connectors can be designed for single-ended signals as well as for differential signals. A single-ended signal is carried on a single signal conducting path, with the voltage relative to a common ground reference being the signal. For this reason, single-ended signal paths are sensitive to any electromagnetic radiation that may couple to signal conductors.

To avoid this sensitivity, signals, particularly low voltage signals, may be communicated differentially. Differential signals are signals represented by a pair of conducting paths, called a "differential pair." The voltage difference between the conductive paths represents the signal. In general, the two conducing paths of a differential pair are arranged to run near each other. If a source of electrical noise is electromagnetically coupled to the differential pair, the effect on each conducting path of the pair should be similar. Because the signal on the differential pair is treated as the difference between the voltages on the two conducting paths, a common noise voltage that is coupled to both conducting paths in the differential pair does not affect the signal. As a result, a differential pair is less sensitive to cross-talk noise, as compared with a single-ended signal path.

Examples of differential electrical connectors are shown in U.S. Pat. Nos. 6,293,827, 6,503,103, 6,776,659, and 7,163,421, all of which are assigned to the assignee of the present application and are hereby incorporated by reference in their entireties.

While electrical connector designs have provided generally satisfactory performance, the inventors of the present invention have noted that at high speeds (for example, signal frequency of 3 GHz or greater), presently available electrical connector designs may not sufficiently provide desired cross-talk, impedance and attenuation mismatch characteristics, particularly for very dense connectors,

SUMMARY OF INVENTION

An improved connector may be provided by providing relatively low insertion to force and high retention force. The force profile may be achieved with a projection from a connector housing that intercepts a beam during connector mating. Initially during the mating sequence, the beam deflects over its entire length. As the beam deflects toward the housing, a central section of the beam contacts the projection, and further deflection is relative to the point of contact with the projection. Following contact with the projection, the beam deflects over a shorter length, yielding a higher spring rate.

An improved surface mount electrical connector may be provided to withstand the heat of a reflow process. The connector may be assembled from wafers with outwardly facing mating contacts that are positioned to apply a balanced force on a retention member associated with the connector housing.

In contrast to a conventional backplane connector in which conductive elements pass straight through the backplane connector housing, some embodiments of the invention may include conductive elements with transition regions. The transition regions allow mating contact portions of the conductive elements in a column to have a different spacing than contact tails for those conductive elements. For example, the mating contact portions of the conductive elements may be positioned along the column with a uniform pitch, but the contact tails may have non-uniform spacing along the column.

An advantage of non-uniform spacing that may be achieved in some embodiments is that contact tails in adjacent columns may be positioned for improved signal integrity or to create a more compact footprint. For example, contact tails of conductive elements in adjacent columns which are intended to be connected to ground may be aligned so that they can be connected to the same pad on a printed circuit board to which the connector is mounted.

A further advantage that may be achieved in some embodiments is that tail portions of conductive elements within a column may be shaped differently. For example, tail portions of conductive elements intended to be connected to ground may be wider than those intended to carry signals or may contain multiple contact tails for attachment to a printed circuit board. The wider ground portions may control impedance in the mating contact portions of conductive elements within the same column. The wider ground portions may alternatively or additionally control impedance of conductive elements in adjacent columns. By using transitions, pairs of signal conductors in one column may align with wider ground portions of conductive elements in an adjacent column.

In some embodiments, the same lead frame may be used for the conductive elements in both columns of each subassembly. By arranging the contact portions on a uniform pitch and positioning the tail portions with a non-uniform spacing, the same lead frame may be used for all columns. When the lead frame is mounted with opposite orientations on each side of a subassembly, a configuration can be created with ground conductors in one column aligning with signal conductors in the adjacent column.

An improved interconnection system may be provided for a surface mount connector. The mounting segment of the connector and connector footprint for a printed circuit board to which the connector may be mounted provide good signal integrity, are compact and are mechanically robust. The footprint includes ground pads positioned so that multiple ground contact tails may be attached to the same pad. Mechanical integrity of the footprint is promoted through the shape of the ground pads. In some embodiments, ground pads may be serpentine and may wind around pairs of signal pads in a column. In other embodiments, the ground pads may include stripes that run between pairs of signal pads in adjacent columns of the footprint. Regardless of specific configuration of the ground pads, the ground pads may be joined with integral conducting straps. The straps may surround signal pads and may also reduce instances of edges in the ground pad in the vicinity of locations where ground contacts are soldered to the footprint. Further mechanical integrity may be provided through the use of vias or microvias in the ground pads.

In some embodiments, a connector a connector may comprising a plurality of subassemblies. Each subassembly may comprise a housing having a midpiece (1010) comprising a first surface and a second surface, opposite the first surface, the housing comprising at least one first ledge adjacent the first surface and at least one second ledge adjacent the second surface, and the housing having a forward mating edge having a first width. Each subassembly also may comprise a first plurality of conductive elements. Each of the first plurality of conductive elements may comprise a mating contact portion adjacent the first surface, the mating contact portion comprising a contact surface facing away from the first surface; and a tip retained by a ledge of the at least one first ledge. Each subassembly also may comprise a second plurality of conductive elements. Each of the second plurality of conductive elements may comprise a mating contact portion adjacent the second surface, the mating contact portion comprising a contact surface facing away from the second surface, and a tip retained by a ledge of the at least one second ledge. In such a connector, the contact surfaces of the first plurality of conductive elements are separated from the contact surfaces of the second plurality of conductive elements by a second width, greater than the first width.

In some embodiments, such a connector further comprising a support member holding the plurality of subassemblies side-by-side. In some embodiments, each subassembly comprises: a first wafer, the first wafer comprising the first plurality of conductive members and a first insulative portion holding the first plurality of conductive members; a second wafer, the second wafer comprising the second plurality of conductive members and a second insulative portion holding the second plurality of conductive members; and a front housing portion receiving the first wafer and the second wafer, the front housing portion comprising the midpiece.

In some embodiments, the at least one first ledge comprises a first plurality of slots positioned to receive ends of the first plurality of conductive elements, a wall of each of the first plurality of slots comprising a ledge of the at least one first ledge. The at least one second ledge may comprise a second plurality of slots positioned to receive ends of the second plurality of conductive elements, a wall of each of the second plurality of slots comprising a ledge of the at least one second ledge.

In some embodiments, the mating contact portions of the first plurality of conductive elements each comprises a compliant member biased toward a ledge of the at least one first ledge with a first force; and the second plurality of conductive elements each comprises a compliant member biased toward a ledge of the at least one second ledge with a first force, the first force and the second force being substantially equal. For each subassembly, the housing may comprise: a first wafer housing, the first wafer housing holding the first plurality of conductive elements; a second wafer housing, the second wafer housing holding the second plurality of conductive elements; and a front housing portion engaging the first wafer housing and the second wafer housing, the front housing portion comprising the midpiece. The compliant members of the mating contact portions of the first plurality of conductive elements may extend from the first wafer housing, and the compliant members of the mating contact portions of the second plurality of conductive elements may extend from the second wafer housing. The first plurality of conductive elements and the second plurality of conductive elements each may comprise conductive elements configured as a plurality of differential pairs and conductive elements configured as ground conductors disposed between adjacent pairs of the plurality of differential pairs.

In some embodiments, an interconnection system may comprise a first connector. The first connector May comprise a plurality of first type subassemblies aligned in parallel, the plurality of first type subassemblies each comprising a wafer of a first type and a wafer of a second type. Each wafer of the first type may comprise a first housing having a first edge; and a plurality of first conductive elements extending through the first edge, each of the plurality of first conductive elements comprising a compliant member comprising a mating contact surface facing in a first direction. Each wafer of the second type comprising a second housing having a second edge; and a plurality of second conductive elements extending through the second edge, each of the plurality of second conductive elements comprising a compliant member comprising a mating contact surface facing in a second direction, the second direction being opposite the first direction. The interconnection system may comprise a second connector adapted to mate with the first connector, the second connector comprising a plurality of second type subassemblies aligned in parallel. Each second type subassembly comprise a housing comprising a first surface and a second surface, the second surface being opposite the first surface, a third plurality of conductive elements exposed in the first surface; and a fourth plurality of conductive elements exposed in the second surface. For each of the first type subassemblies, each of the mating contact surfaces of the first type wafer may contact a conductive element of the third plurality of conductive elements in a first subassembly of the second type, and each of the mating may contact surfaces of the second type wafer contacts a conductive element of the fourth plurality of a conductive elements in a second subassembly of the second type. The first subassembly of the second type and the second subassembly of the second type may be adjacent (as illustrated, for example, in FIG. 11).

In such an interconnection system, the first connector may further comprise a support member; and the plurality of first type subassemblies may be mounted side-by-side on the support member. The second connector may further comprise a second support member, and the plurality of second type subassemblies may be mounted side-by-side on the second support member. Further, in some embodiments, each conductive element of the plurality of first conductive elements, the plurality of second conductive elements, the plurality of third conductive elements and the plurality of fourth conductive elements comprises a surface mount contact tail. In some embodiments, each of the first type subassemblies may comprise a first alignment feature. Each of the second type subassemblies may comprise a second alignment feature adjacent the second surface, the second alignment feature being complementary to the first alignment feature and positioned to align a first type subassembly to one side of the second surface.

In some embodiments, a connector may comprise a plurality of subassemblies. Each subassembly may comprise a plurality of conductive elements, each comprising a contact tail, a mating contact portion and an intermediate portion interconnecting the contact tail and the mating contact portion. The contact tails may be surface mount contact tails and each mating contact portion may have a compliant beam with a distal end. The connector may also comprise a housing holding the intermediate portions of the plurality of conductive elements. The housing may comprise a midpiece (1010) having an edge and first surface on a first side of the midpiece and a second surface on a second side of the midpiece, the edge joining the second side and the first side. The housing also may comprise at least one first feature extending from the first surface adjacent the edge and at least one second feature extending from the second surface adjacent the edge. The plurality of conductive elements may be disposed in a first group having mating contact portions adjacent the first surface and a second group having mating contact portions adjacent the second surface. The compliant beams of the mating contact portions in the first group may be bent such that the distal ends of the mating contact portions of conductive elements in the first group are biased against the at least one first feature. The compliant beams of the mating contact portions in the second group may be bent such that the distal ends of the mating contact portions of conductive elements in the second group are biased against the at least one second feature (as illustrated, for example, in FIG. 10).

In such a connector, for each subassembly, the housing comprises a first wafer housing, a second wafer housing and a forward housing portion, the first group of conductive elements is held within the first wafer housing; the second group of conductive elements is held within the second wafer housing; and the forward housing portion comprises the midpiece.

In such a connector, for each subassembly the mating contact portion of each of the plurality of conductive elements comprises a contact surface; and the plurality of conductive elements is positioned with the contact surface facing away from the midpiece.

In such a connector, each of the surface mount contact tails comprises a lead extending from the housing at a first angle relative to the housing, the lead having a distal end and a bend positioning the distal end at a second angle relative to the housing.

Such a connector may be used with a printed circuit board comprising a plurality of pads. The distal ends of the plurality of leads each may be aligned with a pad of the plurality of pads, and the leads may be reflow soldered to the pads.

Such a connector may be used with a second printed circuit board comprising a second connector, the second connector comprising a plurality of second type subassemblies. Subassemblies of the connector may be each positioned between the adjacent second type subassemblies.

In some embodiments, a connector adapted for mounting to a backplane may comprise at least one housing. Conductive elements may comprise a plurality of columns, with each column comprising a plurality of conductive elements. Each conductive element may comprise a mating contact portion, a contact tail and an intermediate portion therebetween. The mating contact portions may be mounted in the at least one housing in an orientation adapted for mounting in a plane perpendicular to the backplane and the mating contact portions being disposed along the column with uniform spacing. For each of at least a portion of the conductive elements, the intermediate portion of the conductive element may have a transition region in which the intermediate portion jogs such that the contact tail is offset relative to the mating contact portion in a dimension in the plane.

In such a connector, the mating contact portions may comprise blades and the contact tails may comprise surface mount contact tails. The plurality of conductive elements in each column may comprise a first type and a second type, each of the conductive elements of the first type having an intermediate portion that is wider than intermediate portions of the conductive elements of the second type.

In such a connector, in each column, the conductive elements of the second type may be disposed in pairs with a conductive element of the first type positioned between each adjacent pair. Each column may have the same number and shape of conductive elements. Each column may comprise conductive elements in a repeating pattern of a conductive element of the first type, two conductive elements of the second type; and for adjacent columns, the pattern starts at opposite ends of the column. The at least one housing may comprise a plurality of housings, each housing comprising a first housing portion and a second housing portion, with a column of the plurality of columns mounted in the first housing portion and an adjacent column of the plurality of columns mounted in the second housing portion. The mating contact portions of the conductive elements on the column and the adjacent column within each housing may comprise blades, and the blades of the conductive elements on the column and the adjacent column may be each exposed in a surface of the first housing portion. Contact tails of the conductive elements on the column and the adjacent column within each housing may comprise surface mount contact tails.

In some embodiments, a connector may be adapted for mounting to a printed circuit board. Such a connector may comprise conductive elements. The conductive elements may comprise a plurality of columns, each column comprising a plurality of conductive elements, each conductive element comprising a mating contact portion, a contact tail and an intermediate portion therebetween. The mating contact portions of the conductive elements in each of the plurality of columns may be arranged on a first pitch with a first pitch distance, and the contact tails of the conductive elements in each of the plurality of columns being arranged in a repeating pattern of groups of four contact tails. The contact tails within each group may be spaced on a second pitch distance, the second pitch distance being less than the first pitch distance. The groups may be spaced with a third pitch distance, the third pitch distance being greater than the first pitch distance (as illustrated, for example, in FIG. 8).

In such a connector, the conductive elements of each column may comprise a first type conductive element and a second type conductive element. The conductive elements of the first type may have a mating contact portion that is wider than the mating contact portion of the second type conductive element. Each group of four contact tails may comprise one contact tail from each of two first type conductive elements and two second type conductive elements. Each column may comprise a repeating pattern of conductive elements of the first type and two conductive elements of the second type. Each first type conductive element may have two contact tails separated by a planar portion and for each group of four contact tails in a column, the middle two contact tails in each group may align with a planar portion of a first type contact in an adjacent column. The first type conductive elements may comprise ground conductors and the second type conductive elements may comprise signal conductors.

The foregoing summary is not an exhaustive listing of all inventive concepts described herein and is not to be construed as limiting of the attached claims. Moreover, it should be appreciated that the features described above may be used separately or together in any suitable combination.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
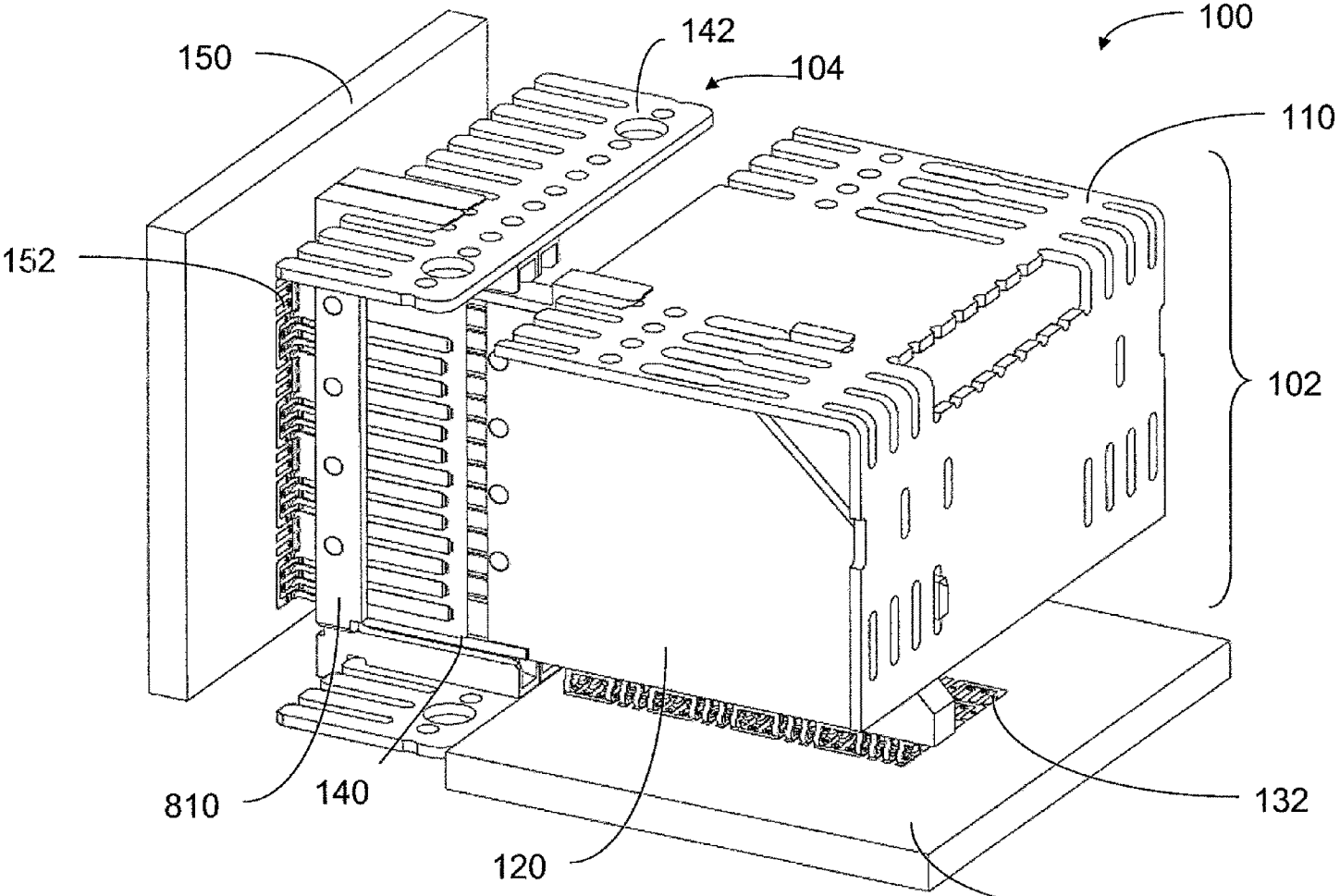
FIG. 1 is a perspective view of a portion of an electrical interconnection system according to some embodiments of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Figure 2:
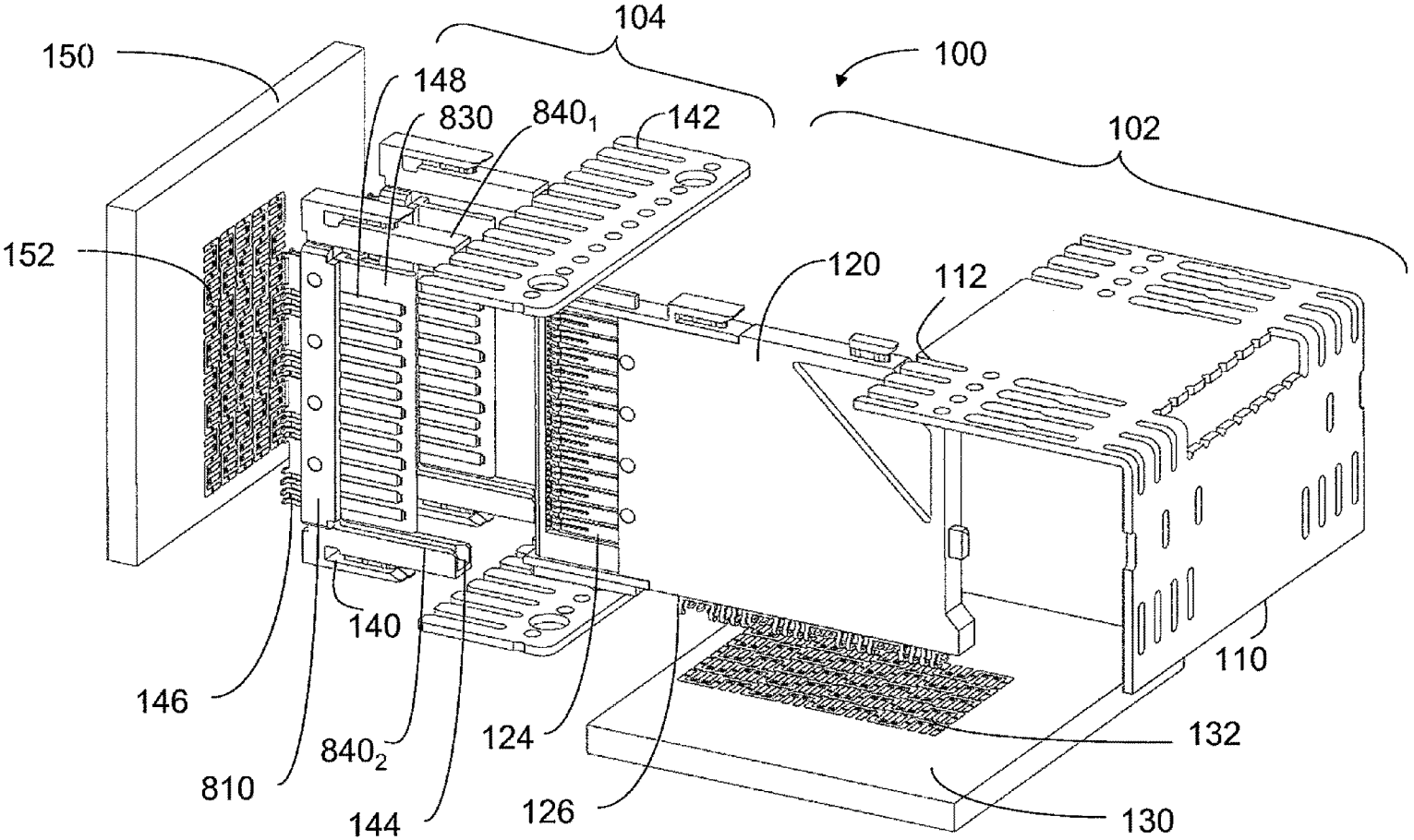
FIG. 2 is an exploded perspective view of the electrical interconnection system of FIG. 1.

Referring to FIGS. 1 and 2, an illustrative portion of electrical interconnection system 100 is shown. The electrical interconnection system 100 includes a daughter card daughter card connector 102 and a backplane connector 104, each of which is attached to a substrate to be connected through interconnection system 100. In this example, daughter card daughter card connector 102 is attached to a printed circuit board configured as a daughter card 130. Backplane connector 104 is attached to a printed circuit board configured as a backplane 150.

Daughter card daughter card connector 102 is designed to mate with backplane connector 104, creating electronically conducting paths between backplane 150 and daughter card 130. Those conducting elements may carry signals or reference voltages, such as power and ground. By interconnecting daughter card 130 and backplane 150 through interconnection system 100, circuit paths are created that allow electronic components on daughter card 150 to function as part of a system containing backplane 150.

Though not expressly shown, interconnection system 100 may interconnect multiple daughter cards having similar connectors that mate to similar backplane connectors. As a result, an electronic system may contain multiple daughter cards connected through backplane 150. Though, for simplicity, only one such daughter card is shown. Accordingly, the number and type of connectors and subassemblies connected through an interconnection system is not a limitation on the invention.

FIGS. 1 and 2 show an interconnection system using a right-angle, backplane connector. It should be appreciated that in other embodiments, an electrical interconnection system may include other types and combinations of connectors, and inventive concepts described herein may be broadly applied in many types of electrical connectors. For example, concepts described herein may be applied to other right angle connectors, mezzanine connectors, card edge connectors or chip sockets.

In the embodiment illustrated in FIG. 1, both daughter card daughter card connector 102 and backplane connector 104 are assembled from multiple subassemblies mounted in parallel. Though FIG. 1 shows the connectors only partially populated with subassemblies, a connector may be populated with any member of subassemblies which may be mounted side-by-side. The subassemblies may be mounted with a spacing on the between about 1.5 and 2.5 mm. As one example, the centerline to centerline spacing between subassemblies may be approximately of 2 mm.

Each of the subassemblies contains a group of conductive elements that complete circuit paths through interconnection system 100 when the backplane and daughter card connectors are 102 and 104, respectively, are mated. Consequently, the number of wafer subassemblies in a connector may be varied in accordance with the desired number of conducting paths through the interconnection system.

In the embodiment illustrated, each of the subassemblies incorporates one or more wafers. Each wafer has conductive elements held in a housing. In the example of FIG. 1, each wafer has a single column of conductive elements and there are two wafers per subassembly. Consequently, each wafer subassembly contains two columns of conductive elements.

Daughter card connector 102 may include a number of wafer subassemblies 120. The wafer subassemblies may be mechanically coupled in any suitable way. In the example of FIG. 1, each of the wafer subassemblies 120 is attached to a support member, illustrated as stiffener 110. Likewise, backplane connector 104 may include a number of backplane wafer subassemblies 140 mounted to stiffeners 142.

In FIG. 1, one wafer subassembly 120 and two wafer subassemblies 140 are shown for simplicity. However, any number of wafer subassemblies, each of which may be in the same form as wafer subassembly 120 or 140, may be mounted to stiffeners 110 or 142

In some embodiments of the electrical interconnection system 100, stiffeners 110 and 142 have slots, holes, grooves or other features that can engage wafer subassemblies. As shown in FIG. 2, stiffener 110 includes multiple parallel slots 112 through which attachment features of wafer subassembly 120 may be attached. Similar slots are included in stiffener 142 for attachment of backplane wafer subassemblies 140.

Wafer subassemblies may include attachment features for engaging a stiffener to locate each wafer subassembly with respect to one another and further to prevent rotation. Of course, the present invention is not limited in this regard, and no stiffener need be employed. Further, although the stiffener is shown attached to an upper and side portion of the plurality of wafer subassemblies, the present invention is not limited in this respect, as other suitable locations may be employed.

Regardless of the manner in which the wafer subassemblies are held together, the conductive elements within each of the wafer subassemblies may be in any suitable form and any number or type of conductive elements may be included. In the illustrated embodiment, conductive elements configured to carry signals are grouped in pairs. Each of the pairs in a column is separated by another conductive element configured as a ground conductor. In the embodiment illustrated, each column includes 4 such pairs. Accordingly, each wafer subassembly, such as wafer subassembly 120, may contain 8 pairs. In some embodiments, the wafer subassemblies may be spaced with a center-to-center distance on the order of 2 mm. Such a configuration results in a connector providing approximately 100 pairs per inch (40 pairs per cm). In other embodiments, other densities are provided.

Regardless of the number and function of the conductive elements, each conductive element may have a mating contact portion, a contact tail and an intermediate portion joining the two. The mating contact portions may be shaped to make electrical connection with a mating contact portion in a complementary connector. The contact tail may be shaped for attachment to a substrate, such as a printed circuit board. The intermediate portions may be shaped to convey signals through the connector without substantial attenuation, crosstalk or other distortion of the signals.

In the embodiment illustrated, each daughter card wafer subassembly 120 has a mating portion that includes the mating contact portions of the conductive elements in the wafer. The mating portion may be positioned between two backplane wafer subassemblies 140 when daughter card connector 102 is mated with backplane connector 104. Conversely, each backplane wafer subassembly 140, with the exception of backplane subassemblies situated at the ends of the backplane connector 104, may also be disposed between two wafer subassemblies 120 upon mating.

In the embodiment illustrated, all of the daughter card wafer subassemblies are substantially identical, and each has mating contacts on two opposing sides of a mating portion. The mating contacts make electrical connections to corresponding mating contacts on backplane wafer subassemblies 140. All of the wafer subassemblies in backplane connector 104 also may be substantially identical and may also have mating contacts on two sides. Though, because the wafer subassemblies at the ends of backplane connector 104 only engage with one wafer subassembly 120, those subassemblies may have a different shape than other wafer subassemblies 140. For example, the wafer subassemblies at one or both ends of connector 140 may have mating contacts on only one side. The mating contacts may be on a surface facing inwards towards the center of backplane connector 140, and there may be no mating contacts on the outward facing surface.

To make electrical connections with signal traces or other conductive elements within the daughter card connector 102 and backplane connector 104 are coupled to daughter card 130 and backplane 150 through contact tails. The conductive elements on daughter card 130 and backplane 150 are shaped and positioned to align with the contact tails from the conductive elements of daughter card connector 102 and backplane connector 104. The pattern of conductive elements on daughter card 130 or backplane 150 positioned to engage contact tails from a connector, such as connectors 102 or 104, is sometimes referred to as the connector "footprint."

In the embodiment illustrated, daughter card 130 and backplane 150 have surface mount contact tails, which are intended to be soldered to pads on the surface of a printed circuit board. Accordingly, the connector footprint includes surface pads. To make connections to conductive structures within the printed circuit board, vias may pass through the pads and intersect the conductive elements within the printed circuit board. For signal pads in the footprint, the vias intersect signal traces within the printed circuit board. Vias through ground pads in the footprint intersect ground planes within the printed circuit board.

Accordingly, FIGS. 1 and 2 illustrate a daughter card footprint 132 containing surface mount pads with vias passing through the pads to make connections to signal traces and ground planes within daughter card 130. Similarly, backplane footprint 152 contains surface mount pads with vias passing through the pads to make connections to signal traces and ground planes within backplane 150.

Conductive elements within connectors 102 and 104 shaped to carry signals may be attached to signal pads in a respective footprint that are coupled to signal traces within a printed circuit board. Likewise, conductive elements shaped to act as grounds may be connected through a foot print to ground planes within a printed circuit board. Ground planes provide reference levels for electronic components, such as those on daughter card 130. Ground planes may have voltages that are at earth ground or positive or negative with respect to earth ground, as any voltage level may act as a reference level. The conductive elements of daughter card connector 102 and backplane connector 104 may have any suitable shape. The mating contact portions of daughter card connector 102 are not visible in the view of FIG. 1. However, in the embodiment illustrated, the mating contacts of daughter card connector 102 are shaped as compliant beams. Each contact may include one or more compliant beams. For example, FIG. 2 illustrates that each mating contact includes two parallel beams.

The mating contacts in backplane connector 104 are shaped to mate with mating contacts from daughter card connector 102. In the illustrated embodiment in which the mating contacts from daughter card connector 102 are shaped as beams, the mating contacts in backplane connector 104 may be shaped to present a surface against which the compliant beams may press. For example, the mating contacts in backplane connector 104 may be shaped as blades or pads that have a flat surface that is exposed in the housing of the backplane connector.

In the example of FIGS. 1 and 2, backplane wafer subassembly 140 has a backplane housing that includes a portion 810 and a housing portion 830. These components are shaped so that the mating contact portions of the plurality conductive elements in the backplane wafer subassembly are exposed. In the embodiment illustrated in which a each wafer subassembly includes two columns of conductive elements, one column of mating contact portions may be exposed in one of two opposing surfaces of the housing. In FIG. 2, exposed portions of one column of conductive elements is exposed, forming mating contacts 148, are visible. In the illustrated embodiment, mating contacts 148 are in the form of blades, although other suitable contact configurations may be employed, as the present invention is not limited in this regard.

FIG. 2 also illustrates tail portions of the conductive contacts within each of daughter card connector 102 and backplane connector 104. Tail portions of daughter card connector 102, shown collectively as contact tails 126, extend below a housing of each of the daughter card wafers and are adapted to be attached to daughter card 130. Tail portions of backplane connector 104, shown collectively as contact tails 146, extend below the backplane housing portion 810 and are adapted to be attached to backplane 150. Here, the contact tails 126 and 146 are surface mount contacts and are in the form of curved leads adapted to be soldered onto contact pads of daughter card footprint 132 or backplane footprint 152 using a reflow operation. However, other configurations are also suitable, such as other shapes of surface mount element contacts, spring contacts, solderable pins, press fits, etc., as the present invention is not limited in this regard.

The components of interconnection system 100 may be formed of any suitable material and in any suitable way. In some embodiments, the housing portions of both daughter card subassemblies and backplane subassemblies may be molded of an insulative material. Examples of suitable materials are liquid crystal polymer (LCP), polyphenyline sulfide (PPS), high temperature nylon or polypropylene (PPO). Other materials known to be used in manufacture of electrical connectors, as well as any other suitable materials, may be employed, as the present invention is not limited in this regard.

In some embodiments, the housing portions may be formed using a binder that incorporates one or more fillers that may be included to control the electrical or mechanical properties of the housing. The above-mentioned materials as well as epoxies and other materials are suitable for use as binder materials in manufacturing connectors according to some embodiments of the invention. For example, thermoplastic PPS filled to 30% by volume with glass fiber may be used to form the backplane connector structure. Such materials may be molded to form housings for the connectors. In some embodiments, such materials may be molded around some or all of the conductive elements in the connector in an insert molding operation. However, any suitable manufacturing techniques may be used to form connectors according to embodiments of the invention.

In some embodiments, some of the housing components may be formed to provide electrically lossy portions positioned at locations to provide preferential attenuation of crosstalk or other noise. As described in more detail below, such portions may be formed using partially conductive fillers in an insulative housing. Though, such portions may be formed in any suitable way. The conductive elements of each connector may also be formed of any suitable material, including materials traditionally used in the manufacture of electrical connector. In some embodiments, the conductive elements are metal. Examples of suitable metals include phosphor-bronze, beryllium-copper and other copper alloys. Conductive elements may be stamped and &limed from sheets of such materials or manufactured in any other suitable way.

To facilitate the manufacture of wafers, signal conductors and ground conductors may be stamped to be held together by one or more carrier strips (not shown) until a housing is molded over the conductive elements. In some embodiments, the signal conductors and ground conductors are stamped for many wafers on a single long sheet. The sheet may be metal or may be any other material that is conductive and provides suitable mechanical properties for making a conductive element in an electrical connector. Phosphor-bronze, beryllium copper and other copper alloys are example of materials that may be used.

Conductive elements may be retained in a desired position by the carrier strips and may be readily handled during manufacture of wafers. Once housing material is molded around the conductive elements, the carrier strips may be severed to separate the conductive elements.

Ground conductors and signal conductors can be formed in any appropriate manner. For example, the respective conductors may be formed as two separate lead frames, which may be overlaid prior to molding of a housing around the conductive elements. As another example, no lead frame may be used and individual conductive elements may be employed during manufacture. It should be appreciated that molding over one or both lead frames or the individual conductive elements need not be performed at all, as a wafer may be assembled by inserting ground conductors and signal conductors into preformed housing portions, or in any other suitable fashion.

In some embodiments, stiffeners 110 and 142 may be a stamped metal member. Though, it can be appreciated that a support member may be made from any appropriate material for suitably providing structure. For example, support members may be formed of any of the dielectric materials that could be used for form a connector housing.

Figure 3:
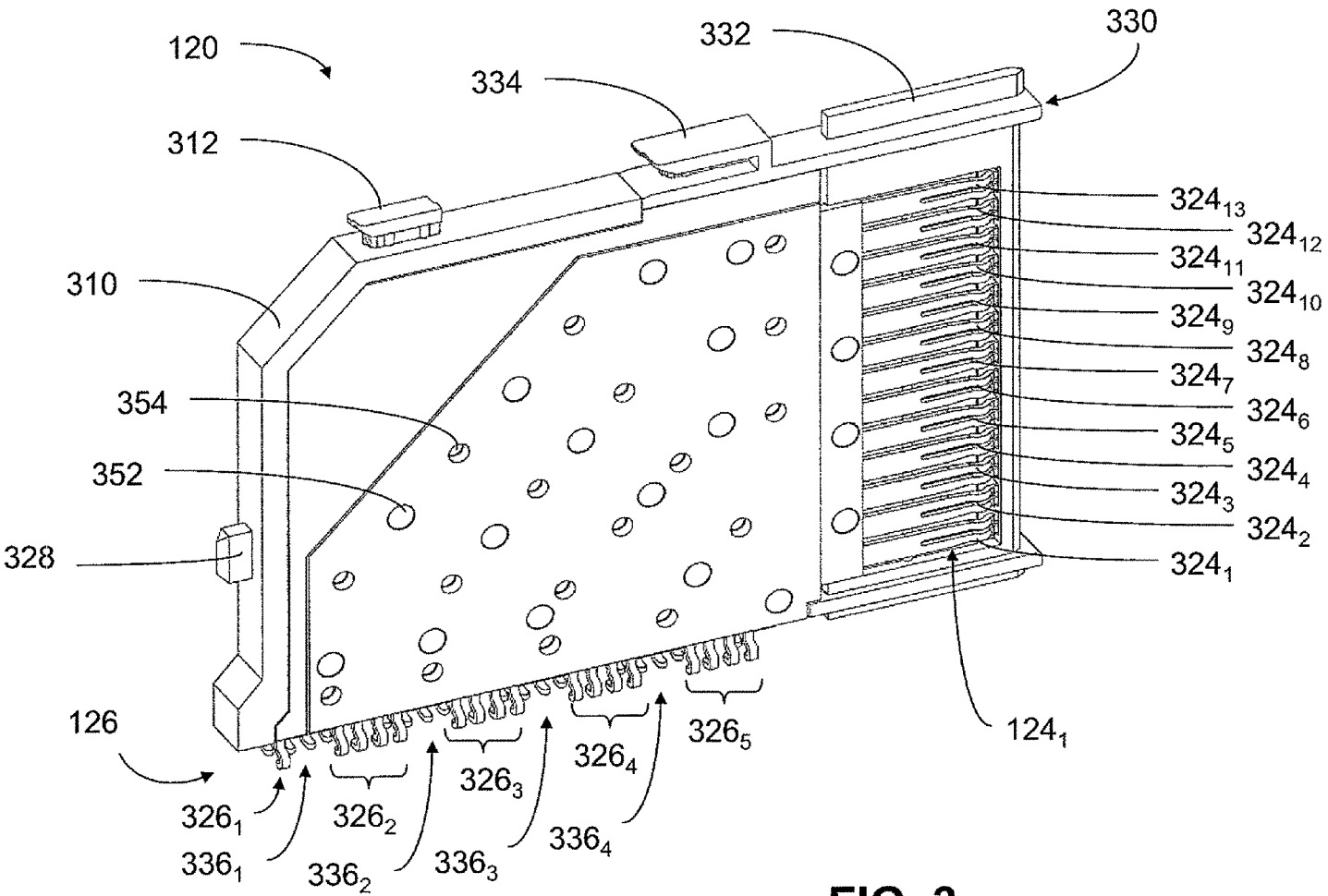
FIG. 3 is a perspective view of a daughter card wafer subassembly according to some embodiments of the present invention.
Figure 4:
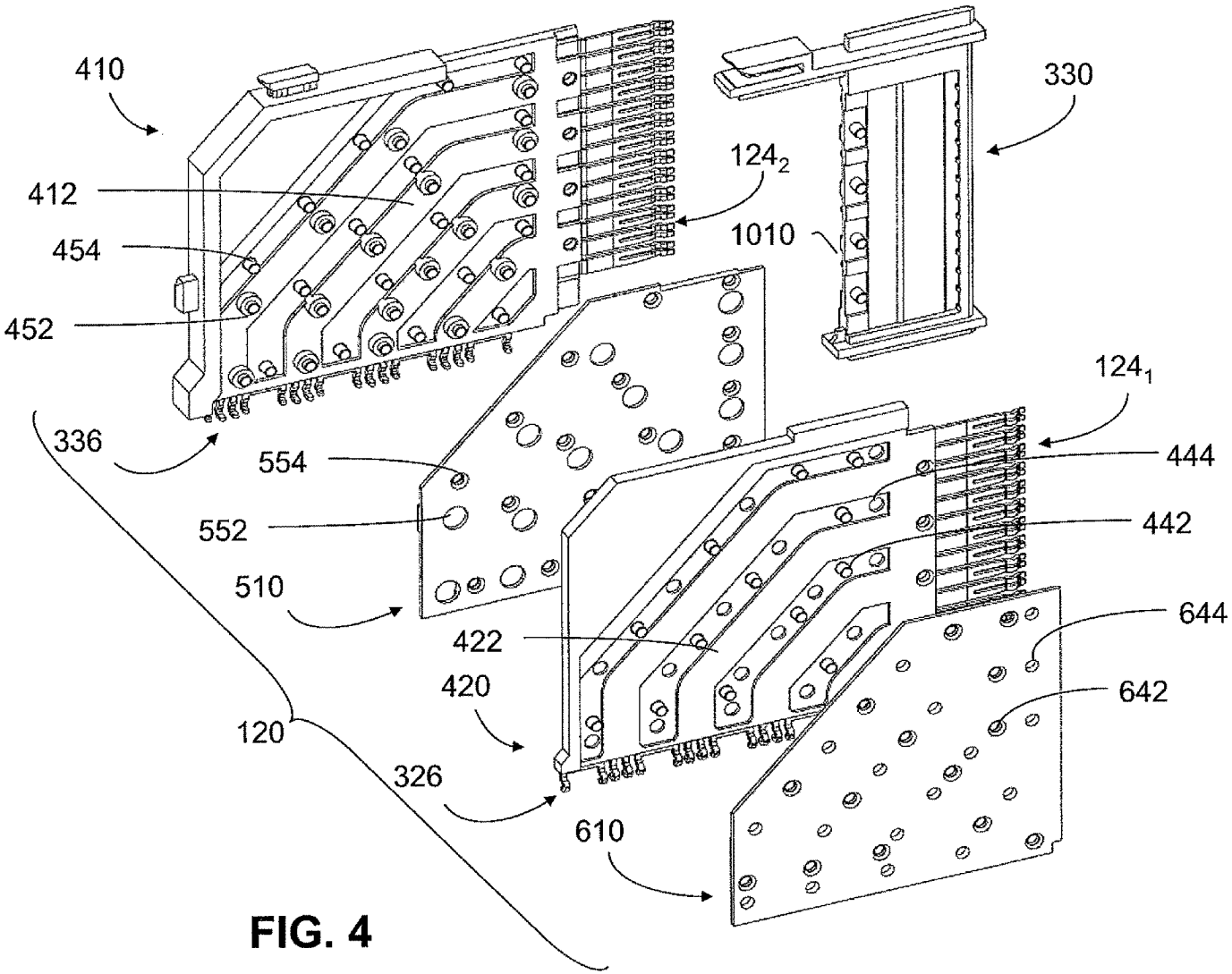
FIG. 4 is an exploded perspective view of the daughter card wafer subassembly of FIG. 3.

Referring to FIGS. 3 and 4, further details of a wafer subassembly 120 according to some embodiments of the invention are illustrated. As can be seen in the exploded view of FIG. 4, wafer subassembly 120 may include a plurality of wafers. In the example of FIG. 4, wafer subassembly 120 is made from two wafers, wafers 410 and 420.

In the illustrated embodiments, each of the wafers has a housing and a column of conductive elements. Each column may include conductive elements shaped to act as signal conductors and conductive elements shaped to act as ground conductors. Ground conductors may be positioned within wafers to minimize crosstalk between signal conductors or to otherwise control the electrical properties of the connector.

Here, the signal conductors are positioned in pairs configured to carry differential signals and ground conductors are positioned adjacent each pair.

The conductive elements may be held within a housing, which may be assembled from one or more pieces. For example, wafer subassembly 120 may be formed with a housing that includes a rear wafer housing 310 and a front wafer housing 330. In some embodiments, rear wafer housing 310 may also be formed in multiple pieces. Each piece of rear wafer housing 310 may be formed as part of a wafer, such as wafers 410 and 420 (FIG. 4).

In the embodiment illustrated, intermediate portions of conductive elements are held within rear wafer housing 310. Such a structure may be created by molding insulative material around a column of conductive elements. As shown, the mating contact portions and contact tails of the conductive elements extend from the rear wafer housing 310. For example, mating contact portions $\mathbf{124}_1$ of wafer 420 extend from the rear wafer housing 310 of wafer 420 and contact portions $\mathbf{124}_2$ of wafer 410 extend from the rear wafer housing 310 of wafer 410.

The mating contact portions from each of wafers 410 and 420 may be positioned in front wafer housing 330 such that the mating contacts $\mathbf{124}_1$ and $\mathbf{124}_2$ on each side of the wafer subassembly 120 are separated by a midpiece 1010 in the front wafer housing 330. Midpiece 1010 may provide structural support for front wafer housing 330 and electrically separate columns of conductive elements in the wafer subassembly 120.

As illustrated, the mating contact portions are compliant beams with a contact area on an outer surface of the beams. Here, the contact surface is formed on a bump on the beam. To enhance electrical contact, the convex surface of such a bump may be coated with gold and/or other material that is electrically conductive and resistant to oxidation. Though, other suitable approaches may be used to create a contact surface. Regardless of how the contact surface is created, it may be exposed in front wafer housing 330 so that, upon mating of a daughter card connector with a backplane connector, the contact surfaces will be exposed for mating with mating contact portions from the backplane connector.

To provide compliance and a force on the contact surface for mating, front wafer housing 330 is shaped so that each of the mating contact portions of mating contacts $\mathbf{124}_1$ may be deflected toward midpiece 1010. Such deflection provides compliance during mating and generates a spring force that will press the mating contact portions from the daughter card connector against corresponding mating contact portions from a backplane connector.

To enhance the amount of compliant motion and the spring force, the mating contact portions may be bent away from mid-piece 1010, such that they are biased to provide an outward force. The distal ends of the mating contact portions $\mathbf{124}_1$ may be retained within front wafer housing 330. In the embodiment illustrated, each of the distal ends may be held under a lip or similarly shaped structure near the forward end of front wafer housing 330. Because of the bias of mating contact portions $\mathbf{124}_1$, in an unmated state they may press outward on the lip. The lip may be sized and positioned to allow the contact portions to move towards midpiece 1010 upon mating.

In the embodiment illustrated, the lip of front wafer housing 330 may be formed with material separating the distal ends of the mating contact portions. In such an embodiment, the lip may resemble a column of slots 1250, as illustrated in conjunction with FIG. 12, below.

The embodiment shown in FIG. 3 illustrates that the housing of wafer subassembly 120 may have one or more attachment features so that the wafer subassemblies may be formed into a connector. In the example embodiment of FIG. 3, each of the attachment features protrudes outward, enabling a structural connection to be made with corresponding stiffeners of the interconnection system 100. Though, attachment features of other shapes are possible, including complementary attachment features in which protrusions from a support member engage a feature on the wafer subassemblies.

Rear wafer housing 310 includes attachment feature 312 that is shaped in a configuration that allows for a slideable connection to be made with corresponding slots 112 on stiffener 110. Rear wafer housing 310 also has attachment feature 328 that allows for a simple insertion to be made with a corresponding slot in stiffener 110 upon connection. Similarly, front wafer housing 330 includes attachment features 334. In the illustrated embodiment, attachment feature 334 may be shaped so as to be slideably connectable with stiffener 110.

Other features may also be formed in the wafer housing. For example, alignment features may be incorporated in the housing. As described above, when a daughter card and backplane connector are mated, each daughter card wafer subassembly 120 fits between two backplane wafer subassemblies 140. To guide the connector into this alignment, daughter card wafer subassembly 120 and backplane wafer subassembly 140 may include complementary alignment features positioned such that, when these features are engaged, the daughter card wafer subassembly 120 will have the desired position relative to the backplane wafer subassemblies 140. In the example of FIG. 3, alignment features 332 may be inserted into grooves 144 in the sidewalls $\mathbf{840}_1$ and $\mathbf{840}_2$ of backplane wafer subassembly 140 (FIG. 1). Though, any other suitable alignment features may be used, whether on the connectors themselves or otherwise as part of interconnection system 100.

As shown in the embodiment in FIG. 3, daughter card wafer subassembly 120 may be a right angle connector, having conductive elements that traverse a right angle. As a result, for this configuration, opposing ends of the conductive elements extend from the wafer subassembly adjacent two perpendicular edges of the wafer subassembly. Those ends of the conductive elements form mating contact portions and contact tails.

As shown in FIG. 3, each conductive element has at least one contact tail, shown collectively as contact tails 126, that can be connected to daughter card 130. Here, the contact tails are group in two columns, with each column associated with one of the wafers in wafer subassembly 120. The contact tails in each column may be further divided into groups of approximately evenly spaced contact tails, with each group separated by a wider spacing than the spacing between contact tails in the group. Accordingly, contact tails 126 may be grouped into contact tail groups $\mathbf{326}_1, \ldots, \mathbf{326}_5$ in one column and contact tail groups $\mathbf{336}_1, \ldots, \mathbf{336}_4$ in the other column of wafer subassembly 120. In the embodiment illustrated, each group, with the exception of the groups at the end of each column, contains four contact tails, two corresponding to signal conductors of a differential pair and two corresponding to ground conductors positioned in the column adjacent either side of the pair.

In the embodiment illustrated, the groups of contact tails in adjacent columns within wafer subassembly 120 partially overlap. As shown, the contact tails of ground conductors in one column align with contact tails of ground conductors in the adjacent column. In contrast, the contact tails associated with each pair of signal conductors align with a space between two groups in the adjacent column. When multiple wafer subassemblies are aligned side-by-side to form a connector, this pattern repeats from column to column across the connector. As will be described in greater detail below, such a configuration contributes to a compact footprint that enables a high density connector.

As shown, contact tails 126 are shaped in a hooked configuration where the end curves outward and back to form a surface that suitably provides for electrical communication to conductive pads on daughter card 130. In FIG. 1, contact tails 126 form an electrical connection with daughter card 130 by being soldered to daughter card footprint 132 using a surface mount printed circuit board manufacturing process. Though, any suitable method may be used for attaching a connector to a substrate, and the contact tails may be shaped appropriately for the specific manufacturing process to be used to attach a connector to a printed circuit board or other substrate.

In some embodiments, the contact tails of all of the conductive elements in a wafer subassembly may be the same shape and may be aligned in the same direction. However, in the embodiment of a daughter card wafer subassembly illustrated, the distal ends of the pad-shaped portions of the conductive elements in adjacent columns face in opposite directions. As illustrated, the distal, or toe, portion of the contact tails in adjacent columns of a wafer face towards each other.

Additionally, the pad-shaped portions at the ends of the contact tails may be of different sizes. As illustrated, the pad-shaped portions for contact tails associated with ground conductors are shorter than for those associated with signal conductors. Because of the orientation of groups of conductors and the size of the ground contact tails, it is possible for contact tails associated with ground conductors in adjacent columns to be attached to the same pad. As a result, the illustrated configuration leads to a compact connector footprint, as illustrated in more detail below in connection with FIGS. 9A, 9B, and 9C.

The opposite end of each conductive element may form a mating contact portion. The mating contact portions in wafer subassembly 120 are shown collectively as mating contacts 124, each of which can form a separable connection to a corresponding conductive element in backplane wafer subassembly 140. Here, mating contacts 124 are all of the same size and are mounted with the same center-to-center spacing. Dual beam contacts $\mathbf{324}_1, \ldots, \mathbf{324}_{13}$ on one side of wafer subassembly 120 are visible in FIG. 3. Mating contact portions may also be positioned on the other side of wafer subassembly 120, but are not visible in the view of FIG. 3.

On both sides of wafer subassembly 120 (only one side is shown in FIG. 3), outwardly facing mating contacts 124 engage with front wafer housing 330 such that mating contact ends may slide under a lip molded into the housing. The outward facing mating contact portions allow for a suitable connection to occur once wafer subassembly 120 and backplane wafer subassembly 140 are mated. In this regard, upon engagement of front wafer housing 330 and mating contacts 124, an insulative material in front wafer housing 330 separates one side of mating contacts from the other. Though, the forward edge of front wafer housing 330 has a width that is less than the spacing between the mating contact surfaces of contacts 124. As a result, the mating contacts portions will be accessible in the sides of front wafer housing, where they may mate with mating contact portions in a complementary connector.

In the embodiments illustrated, the conductive elements acting as signal is conductors are grouped in pairs in a configuration suitable for use as a differential electrical connector. However, embodiments are possible for single-ended use in which the conductive elements are evenly spaced without designated ground conductors separating signal conductors or with a ground conductor between each signal conductor.

FIG. 4 illustrates an exploded view of wafer subassembly 120, including connector wafers 410 and 420, conductive plastic inserts 510 and 610, and front wafer housing 330. These parts may be formed separately and held together in any suitable way. As one example, the components may be held together using adhesives, such as epoxy. Alternatively, the parts may be held together using one or more attachment features, such as snap fit or interference fit features. As a further possibility, a riveting or staking procedure may be used in which projections on one part extend through a hole in another part. An extending portion of the projections may be deformed to have a diameter larger than the hole to prevent the parts from separating. The projection may be deformed in any suitable way, such as by application of pressure or pressure in combination with heat that softens the projection.

Regardless of the mechanism used to assemble the parts, the parts of wafer subassembly may be assembled in any suitable order. For example, in some embodiments conductor wafer 410 may incorporate attachment pins, such as pins 452 and 454. Both types of pins may be positioned to align with holes in lossy insert 510. Pins 454 may be deformed against a surface of lossy insert 510 to stake lossy insert to wafer 510. Similar pins 442 may project from wafer 420. Pins 442 may pass through holes in lossy insert 610 and be deformed to secure lossy insert 610 to wafer 420.

A similar staking technique may be used to attach front housing portion 330 to wafers 410 and 420. In the embodiment of FIG. 4, front housing portion 330 includes pins 1210. Pins 1210 may be positioned so that, when the mating contact portions of the conductive elements of wafer 420 are positioned in front housing portion 330, pins 1210 pass through holes in wafer 420. As illustrated, pins 1210 are positioned to pass through holes 460 in wafer 420 and holes in lossy insert 610, such as holes 644. The pins then may be deformed to affix wafer 420 and lossy insert 610 to front housing portion 330.

A similar approach may be used to secure wafer 410 and lossy insert 510 to front housing portion 330. Pins, similar to pins 1210, on an opposite surface (not visible in FIG. 4) of front housing portion 330, may pass through similar holes (not numbered) in lossy insert 510 and wafer 410. Those pins may then be deformed.

Attachment of lossy inserts 510 and 610 to wafers 410 and 420, respectively, and attachment of wafers 410 and 420 to front housing portion 330 may provide adequate attachment for the components of wafer subassembly 120. To provide additional mechanical integrity, further attachment features may be included. For example, attachment features may be used to attach wafers 410 and 420 to each other. In the embodiment of FIG. 4, pins 452 pass through holes 552 in lossy insert 510. Pins 452 continue through holes in wafer 420, such as holes 444, and holes in lossy insert 610, such as holes 644. The extending portion of pins 452 may then be deformed against the surface of lossy insert 610, securing wafer 410, lossy insert 510, wafer 410 and lossy insert 610, with front housing portion 330 held between wafers 410 and 420.

In the embodiment illustrated, pins 452 are positioned such that holes in wafer 420 that receive pins 452 do not pass through an area holding signal conductors. Rather, pins 452 are positioned above a pair of signal conductors of wafer 410. Because the pairs of signal conductors in wafer 410 are aligned with ground conductors are wafer 420, this alignment positions a hole that receives a pin 452 above a ground conductor within wafer 420. Accordingly, any hole through a wafer 410 or 420 used for attachment, if the hole pierces a conductive element will pass through a ground conductor where the impact on signal integrity will be small.

The components may be held together with any suitable number of staking operations, which may be performed in any suitable order. For example, one operation may be used to attach lossy insert 510 to wafer 410. In a subsequent operation, pins 442, 452 and 1210 may all be deformed. In the same operation, pins from front housing portion passing through wafer 410 may simultaneously be deformed, such that all of the components of wafer subassembly 120 may be attached in two separate operations. Though, other sequences are possible. For example, lossy insert 610 could be secured to wafer 420 in a separate operation, resulting in three staking operations.

The components of wafer subassembly 120 may be formed in whole or in part by injection molding of thermoplastic materials into the desired shapes. Though, any suitable method of forming components in the desired shape may be used. To form wafers 410 and 420, insulative material may be molded around conductive elements. The insulative material may be shaped to form rear wafer housing 310 with portions of the conductive elements embedded therein. Front housing portion 330 may be separately molded of insulative material. Lossy inserts 510 and 610 may also be molded in a separate operation using thermoplastic material with conductive fillers providing desired loss properties.

In the pictured embodiment, components of the wafer subassembly 120 are formed separately, allowing for material to be used having different material properties. In this regard, any suitable number and types of material may be used in the component pieces of wafer subassembly 120. Though, different materials may be combined even if the components are not formed separately. For example, two-shot molding may be used to combine insulative and lossy material in a shape achieved by staking lossy insert 510 to wafer 410.

In some embodiments, wafer subassemblies 120 may be provided with openings, such as windows or holes. These openings may serve multiple purposes, for example, including ensuring that the conductive elements are properly positioned during an injection molding process, facilitating insertion of materials that have different electrical properties, if so desired, and serving to attach components of the wafer subassembly 120 together.

As shown in FIG. 4, conductor wafer 410 includes mating contacts $\mathbf{124}_2$ electrically connected to and oriented perpendicularly with respect to contact tails 336. In some cases, mating contacts $\mathbf{124}_2$ and contact tails 336 may be connected through a plurality of signal paths. The signal paths may be surrounded by any suitable electrically insulating material, such as, for example, a dielectric material. As a result, each wafer may contain raised portions 412 in the vicinity of signal paths.

Figure 5:
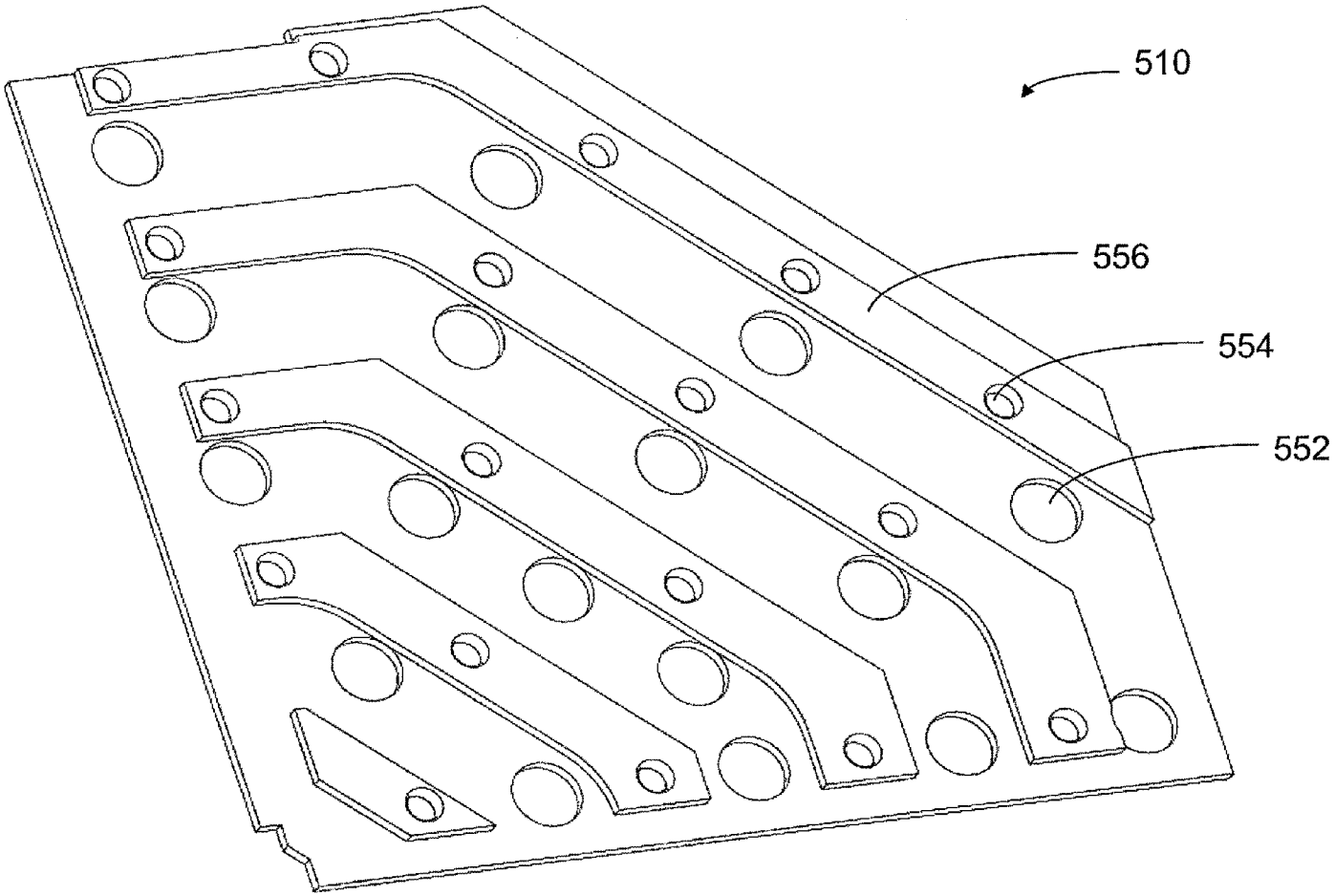
FIG. 5 is a perspective view of a first conductive plastic piece of FIG. 4.

Referring to FIG. 5, lossy insert 510 is shown in greater detail. Lossy insert 510 includes attachment holes, such as, for example, holes 552 and 554. Some attachment holes are larger than other holes. FIG. 5 illustrates attachment hole 552 to be larger than attachment hole 554. Such sizing allows attachment hole 552 to receive an attachment pin 452 located on conductor wafer 410. Similarly, attachment hole 554 are sized to receive an attachment pin 454 located on conductor wafer 410.

Also, lossy insert 510 includes ribs 556 that are sized and positioned to fit between raised portions 412. As illustrated in FIG. 4, portions 412 of wafer 410 containing signal conductors, such as for example, signal path 412, may be elevated, leaving troughs in the rear wafer housing 330 between pairs of signal conductors. Ridges 556 are shaped and positioned to fit within these troughs. In this regard, ridges 556 allow the lossy insert 510 to have a complementary shape with respect to wafer 410.

Lossy insert 510 may be made of any suitable lossy material. Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally be between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz. or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemans/meter to about $6.1\times10^7$ siemans/meter, preferably about 1 siemans/meter to about $1\times10^7$ siemans/meter and most preferably about 1 siemans/meter to about 30,000 siemans/meter. In some embodiments material with a bulk conductivity of between about 25 siemans/meter and about 500 siemans/meter may be used. As a specific example, material with a conductivity of about 50 siemans/meter may be used.

Electrically lossy materials may be partially conductive materials, such as those that have a surface resistivity between 1Ω/square and $10^6$Ω/square. In some embodiments, the electrically lossy material has a surface resistivity between 1Ω/square and $10^3$Ω/square. In some embodiments, the electrically lossy material has a surface resistivity between 10Ω/square and 100Ω/square. As a specific example, the material may have a surface resistivity of between about 20Ω/square and 40Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. In some embodiments, the conductive particles disposed in filler element 295 may be disposed generally evenly throughout, rendering a conductivity of filler element 195 generally constant. An other embodiments, a first region of filler element 295 may be more conductive than a second region of filler element 295 so that the conductivity, and therefore amount of loss within filler element 295 may vary.

The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. Examples of such materials include LCP and nylon. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which acts as a reinforcement for the preform. Such a preform may be inserted in a wafer to form all or part of the housing. In some embodiments, the preform may adhere through the adhesive in the preform, which may be cured in a heat treating process. Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

Figure 6:
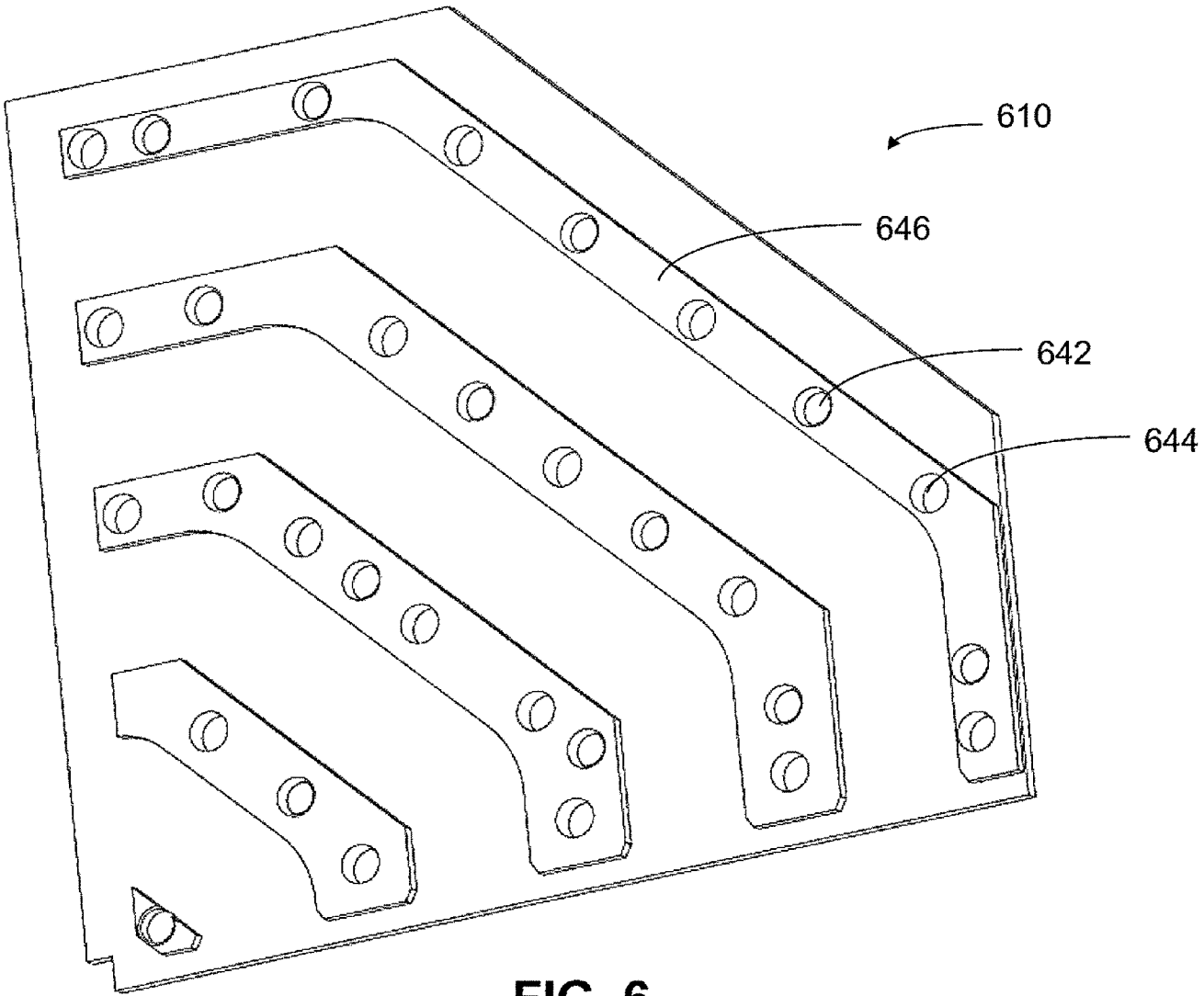
FIG. 6 is a perspective view of a second conductive plastic piece of FIG. 4.

FIG. 6 shows a lossy insert 610, adapted for attachment to wafer 420. Here wafer 420 is similar to wafer 410, though the mating contact surfaces face in opposite direction and the contact tails in each form a column with a different configuration. These differences do not require different construction techniques. Accordingly, lossy insert 610 may be made similarly to lossy insert 510 with a number of attachment holes 642 and 644 and ridges 646. In the illustrated embodiment, attachment holes 642 are designed to receive attachment pins 442 from wafer 420. Attachment holes 644 are designed for insertion of attachment pins 452 from wafer 410. Similar to ridges 556 of lossy insert 510, ridges 646 are shaped to fit within complementary troughs in wafer 420.

Some or all of the construction techniques employed within a wafer subassembly 120 for providing desirable electrical and mechanical characteristics may be employed in backplane wafer subassembly 140. In the illustrated embodiment, backplane wafer subassembly 140, like wafer subassembly 120, includes features for providing desirable signal transmission properties. Signal conductors in backplane wafer subassembly 140 may be arranged in columns, each containing differential pairs interspersed with ground conductors. The ground conductors may be wide relative to the signal conductors. Also, adjacent columns may have different configurations. In some embodiments, a pair of signal conductors in one column may be aligned with a ground conductor in another column. In this respect, a signal pair in one column may be closer to a ground conductor than a signal pair in adjacent columns. Though the ground conductors do not align from column to column, contact tails from ground conductors in one column may align with contact tails from ground conductors in an adjacent column to facilitate attachment of ground conductors in adjacent columns on the same pad of the connector footprint.

Figure 7:
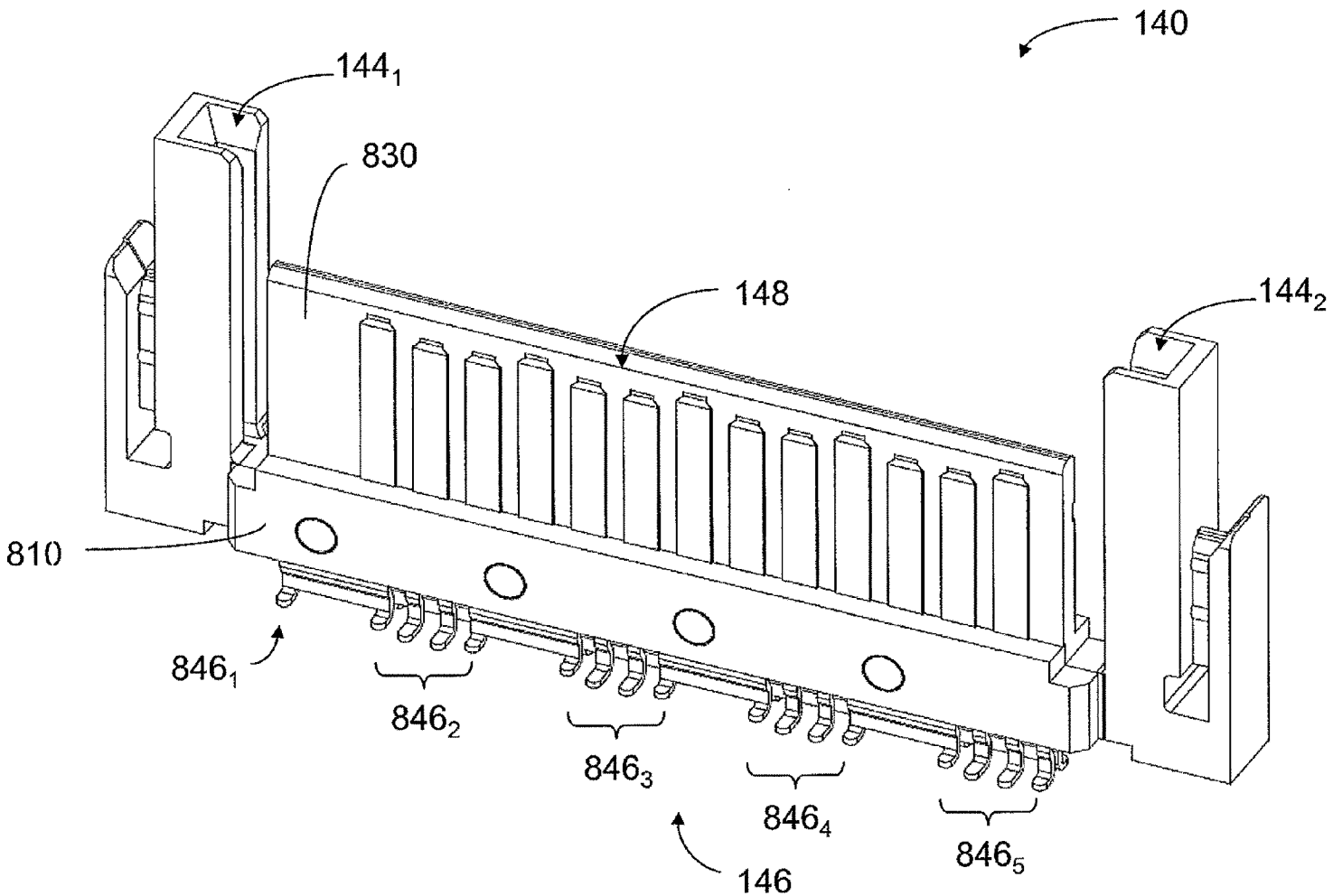
FIG. 7 is a perspective view of a backplane subassembly according to some embodiments of the present invention.
Figure 8:
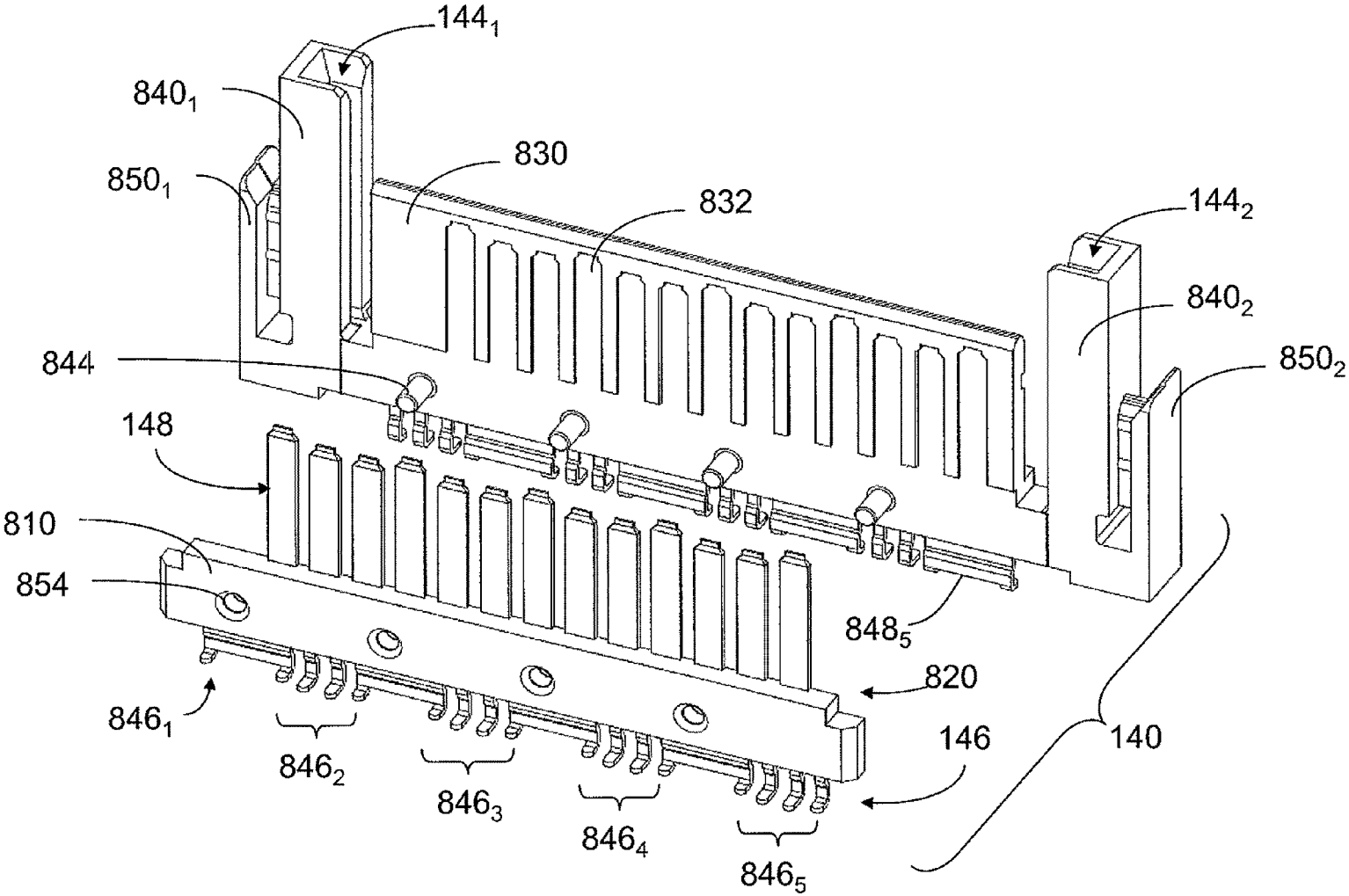
FIG. 8 is an exploded perspective view of the backplane subassembly FIG. 7.

Referring to FIGS. 7 and 8, backplane wafer subassembly 140 has a plurality of conductive elements shaped and positioned to provide an electrical connection between mating contacts 124 of wafer subassembly 120 and backplane 150. In the illustrated embodiment, backplane wafer subassembly 140 includes grooves $\mathbf{144}_1$ and $\mathbf{144}_2$, that engage with attachment features 332 on either side of daughter card front wafer housing 330 of a wafer subassembly 120. Attachment features $\mathbf{850}_1$ and $\mathbf{850}_2$ (FIG. 8) engage with backplane stiffener 142 (FIG. 1) to hold multiple backplane wafer subassemblies 140 side-by-side.

Conductive elements of backplane wafer subassembly 140 are positioned so that their mating contact portions align with the mating contact portions of the conductive elements in wafer subassembly 120. Accordingly, FIG. 7 shows conductive elements in backplane wafer subassembly 140 arranged in multiple parallel columns. In the embodiment illustrated, each of the parallel columns includes multiple signal conductors that are configured as differential pairs with adjacent ground conductors between each pair. In the embodiment illustrated, the mating contact portion of the ground conductors are longer than the mating contact portion of the signal conductors.

For each backplane wafer subassembly 140 two lead frames 820 each adapted to mate with one column of conductive elements from a daughter card connector. In the embodiment illustrated, each of the lead frames 820 is the same, though oriented in opposite directions. Each lead frame 820 includes mating contact portions 148. In the embodiment illustrated, each mating contact portion is shaped as a blade or pad and positioned for a dual beam contact from a daughter card wafer subassembly 120 to press against when a daughter card and backplane connector are mated.

As is apparent in the exploded view of FIG. 8, backplane wafer subassembly 140 may be assembled from separate pieces. Each of the lead frames 820 may be insert molded in insulative material to hold the conductive elements of the lead frame and form portions of backplane connector housing. In the embodiment illustrated, one lead frame 820 is held within housing portion 810, which may be formed of any appropriate insulative material. A second lead frame 820 may be molded in a housing portion 830.

The backplane housing portions may be shaped to facilitate construction of backplane wafer subassembly 140. In the embodiment illustrated in FIGS. 7 and 8, backplane connector housing portion 810 also includes attachment holes 854 that are shaped and positioned to engage with attachment pins 844 located on the housing 830. As with the portions of daughter card wafer subassembly 120, housing portions 810 and 830 may be held together by deforming attachment pins in a staking operation. Though, any suitable attachment mechanism may be used.

Housing 830 includes lead frame slots 832 (FIG. 8) that are shaped to receive mating contacts 148 of lead frame 820 held in housing portion 810. FIG. 7 depicts conductive elements of a lead frame 820 in housing portion 810 when housing portion 810 is connected to housing portion 830. As can be seen, the mating contact portions of those conductive elements fit within slots in housing portion 830 but are exposed in a surface of the backplane wafer subassembly 140. Though not visible in FIG. 7, the mating contact portions of conductive elements in housing portion 830 are similarly exposed in the opposite surface of the housing portion 830. In this way, a backplane wafer subassembly 140 provides two columns of conductive elements, each of which can make connections to a column of conductive elements in a daughter card wafer subassembly 120 positioned in a connector assembly on either side of the backplane wafer subassembly 140.

Each of the conductive elements in a backplane wafer subassembly also includes contact tail 146, which are grouped in contact tail groups $\mathbf{846}_1, \ldots, \mathbf{846}_5$. With the exception of group $\mathbf{846}_1$, which is positioned at the end of a column, in the illustrated embodiment each of the groups has four contact tails—two associated with a pair of signal conductors, and two on either side of the pair, associated with ground conductors.

As illustrated by the example embodiment of FIG. 8, the mating contact portions of both signal and ground conductors are approximately the same width. However, the contact tail portions of the ground conductors are relatively wide relative to those of the signal conductors, resulting in a relatively wide, generally planar portion, such as planar portion $\mathbf{848}_5$ for each ground conductor.

Each ground conductor may have multiple contact tails extending from a planar portion. Here two contact tails are shown. Within backplane wafer subassembly 140, the wide planar portion from a ground conductor will align with ground contact tails in one of the groups $\mathbf{846}_2, \ldots, \mathbf{846}_5$ in an adjacent column. As illustrated, the planar portion extends below the housing portions 810 and 830 and aligns with the pair of signal conductors in the group. For example, planar portion $\mathbf{848}_5$ aligns with the contact tails of signal conductors in group $\mathbf{846}_5$. Similar planar portions associated with other ground conductors are positioned adjacent other pairs of signal conductors.

In the illustrated embodiment, backplane wafer subassembly 140 is not shown with lossy inserts analogous to lossy inserts 510 and 610 used in daughter card wafer subassemblies 120. However, in some embodiments lossy material may be incorporated into backplane wafer subassembly 140. Lossy material could be incorporated through the use of inserts into either or both of housing portions 810 and 830. Alternatively, lossy material may be incorporated through the deposition of conductive ink or other conductive coating or films on surface or in channels formed in the surfaces of either or both of housing portions 810 and 830.

In the embodiment illustrated, the conductive elements in a backplane wafer subassembly 140 extend in groups of four conductive elements similar to those in daughter card wafer subassembly 120. Accordingly, similar footprints may be used for mounting either a backplane connector or a daughter card connector. The footprint associated with a backplane connector, like a foot print for a daughter card connector, may have parallel columns of signal pads and ground pads. The ground pads may be shaped for attachment on contact tails from ground conductors in adjacent columns. Though, as can be seen in FIG. 3, the toe portions of contact tails in the columns of a daughter card wafer subassembly 120 face inwards towards the other half of the same wafer subassembly, but, as can be seen in FIG. 7, the contact tails in the columns of a backplane wafer subassembly 140 face outward towards an adjacent subassembly. As a result, the pattern of signal and ground contact tails existing within one daughter card wafer subassembly exists between two halves adjacent backplane wafer subassemblies. Thus, though the pattern of signal and ground pads in the footprints for the daughter card and backplane may be generally the same, that pattern is shifted in the backplane relative to the daughter card by an amount equal to one half a wafer subassembly.

Figure 9A:
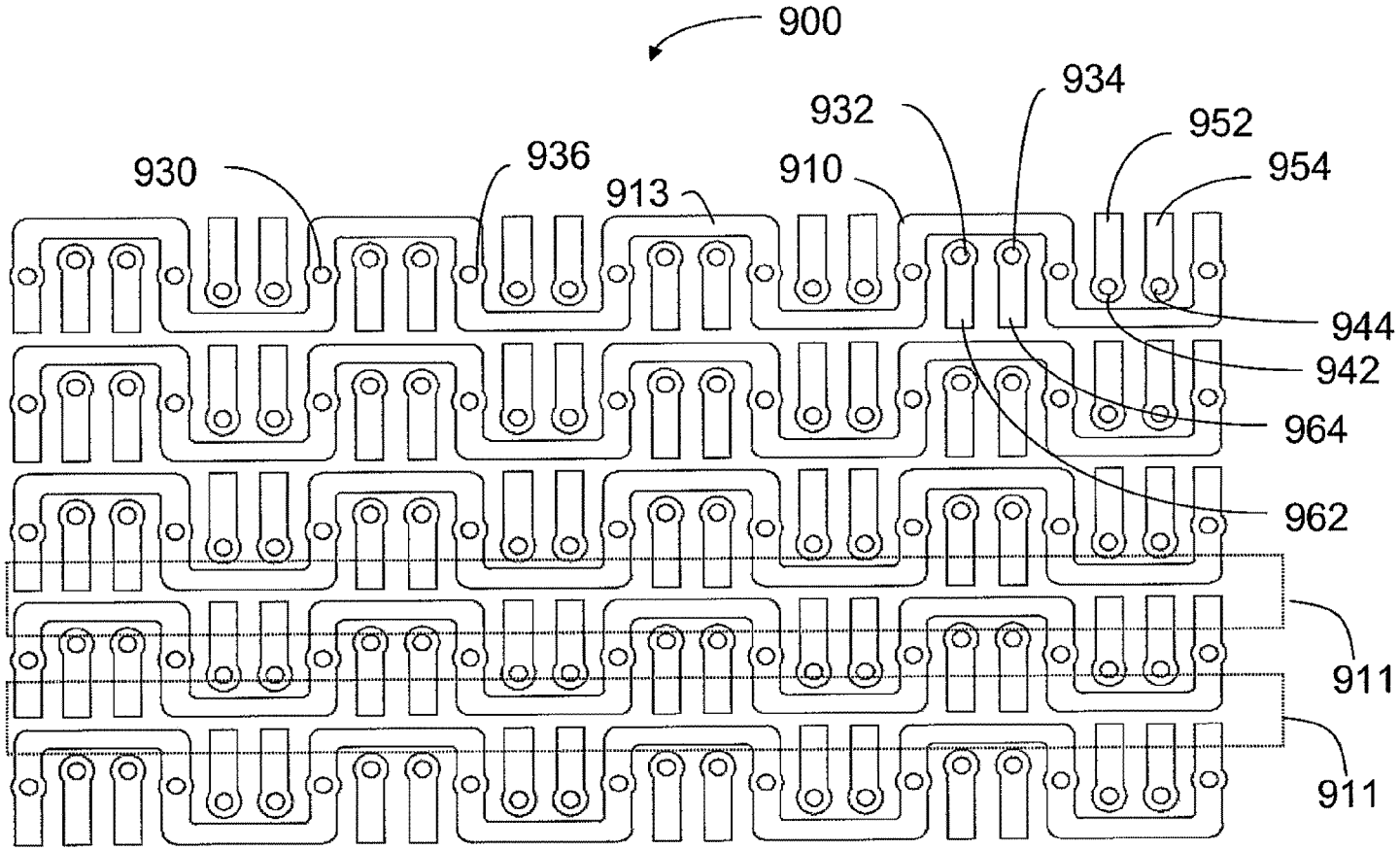
FIG. 9A is a top view of a connector footprint according to some embodiments of the present invention.

FIG. 9A shows a footprint pattern 900 for some illustrative embodiments with regard to backplane 150 or daughter card 130. For the example shown, footprint pattern 900 includes mounting pads where contact tails from either the backplane wafer subassembly 140 or wafer subassembly 120 may establish an electrical connection. In the embodiment illustrated, electrical connection is established through a surface mount reflow solder process. However, any suitable attachment mechanism may be used.

Mounting pads may be patterned in any suitable fashion, including known printed circuit board manufacturing techniques. Though, it is not a requirement that the footprint be formed on a surface of a printed circuit board, as any other suitable substrate may be used for attachment of a connector, In FIG. 9A, ground conductor mounting pads 910 are patterned in a serpentine fashion surrounding signal conductor mounting pads, of which pads 952, 954, 962, and 964 are numbered. Here, signal conductor mounting pads 952 and 954 correspond to signal conductors in one differential pair and signal conductor mounting pads 962 and 964 correspond to signal conductors in a second differential pair. As can be seen in FIG. 9A, the ground conductor pads border each pair of pads, but do not separated the pads of the pair. In the embodiment illustrated, each pair of signal conductor mounting pads is separate in all directions from an adjacent signal conductor mounting pad by a ground conductor mounting pad.

Conductive vias may be used to couple each of the pads to either a signal trace or ground plane within the printed circuit board on which the footprint is formed. Such vias may be formed using techniques known in the art, such as by drilling a hole and plating the hole with conductive material. However, any suitable mechanism may be used to form a connection between a pad and conductive element within the printed circuit board.

Conductive vias are also depicted in FIG. 9A. Ground conductive vias 930 and 936 are shown along the path of ground conductor mounting pad 910. Signal conductive vias 932 and 934 are shown on one end of signal conductor mounting pads 962 and 964, respectively. Similarly, signal conductive vias 942 and 944 are shown on an opposite an end of signal conductor mounting pads 952 and 954, respectively.

The illustrated positioning of the vias for both signal conductor mounting pads and ground conductor mounting pads results in the vias used for pads in two adjacent columns being disposed generally along a line parallel to the columns but in between the columns. As a result, there is relatively wide area between every two columns that may be used as routing channels 911. Within the printed circuit board on which footprint 900 is formed, routing channels 911 may be generally free of vias. Accordingly, traces carrying signals may be easily routed within routing channels 911 without bends or jogs to avoid vias that can cause impedance discontinuities in the traces. Thus, the illustrated footprint, though compact, can be readily used in circuit board without the addition of additional layers to accommodate traces needed to route signals to or through the connector footprint. In some embodiments, the traces carrying signals to the signal vias within the footprint may be routed on a single layer.

Footprint 900 also provides desirable mechanical properties for interconnection system 100, particularly for very dense connectors. The inventors have recognized and appreciated that dense connectors, with small center-to-center spacing between mounting pads, have small mounting pads that creates a point of weakness in the interconnection system. In particular, small pads that adhere only to a relatively small area of the surface of the printed circuit board are susceptible to delamination if stressed. A twisting force on a connector may provide sufficient force to separate a pad from the printed circuit board, particularly if the force has a component that tends to lift one end of wafer subassembly of the connector away from the printed circuit board. Such a force could be applied to a connector once mounted to a printed circuit board if, for example, a daughter card and backplane are misaligned when an attempt is made to mate them or some other unexpected force is applied to the connector.

The extended nature of the ground pads helps prevent delamination, even in the face of such forces on the connector. The adhesion between the ground pad and the board is proportional to the surface area over which the pad is adhered to the board. Extending the ground pads to at least partially surround a pair of signal conductor mounting pads and/or positioning a ground pad for attachment of contact tails from ground conductors in adjacent columns increases the size of the ground pads and therefore increases the area over which a ground pad is attached to a surface of a printed circuit board. As a result, the extended ground pads are less susceptible to delamination.

Similar enlargement of signal conductor mounting pads is not required to achieve mechanical benefits. In footprint 900, because each column ends with a ground pad, the ends of each column are better secured because of the enlarged ground pads. If the pads at the ends of a column remain attached to the printed circuit board, the signal pads in the middle of such a column will be isolated from such forces and are less likely to separate from the surface of the board.

Footprint 900 also provides desirable electrical properties. The serpentine shape of the ground pads includes segments, such as segment 913, parallel to the columns in the footprint and adjacent pairs of signal conductors. The relatively wide ground portions, such as $\mathbf{848}_5$ (FIG. 8), align with these segments, creating a nearly continuous ground structure between signal conductors in adjacent columns.

The pads of footprint 900 may be made with any suitable dimensions. As one example, each signal pad, such as pad 962 or 964 may have an area for receiving a contact tail that is substantially rectangular with a width on the order of 0.35 mm and a length of about 0.85 mm. A via, such as via 932 or 934 may be surrounded by a portion of the pad that has a diameter on the order of 0.5 mm. A ground pad, such as ground pad 910 may have a width that is on the same order as a signal pad or less than the width of a signal pad, such as 0.25 mm or less.

Figure 9B:
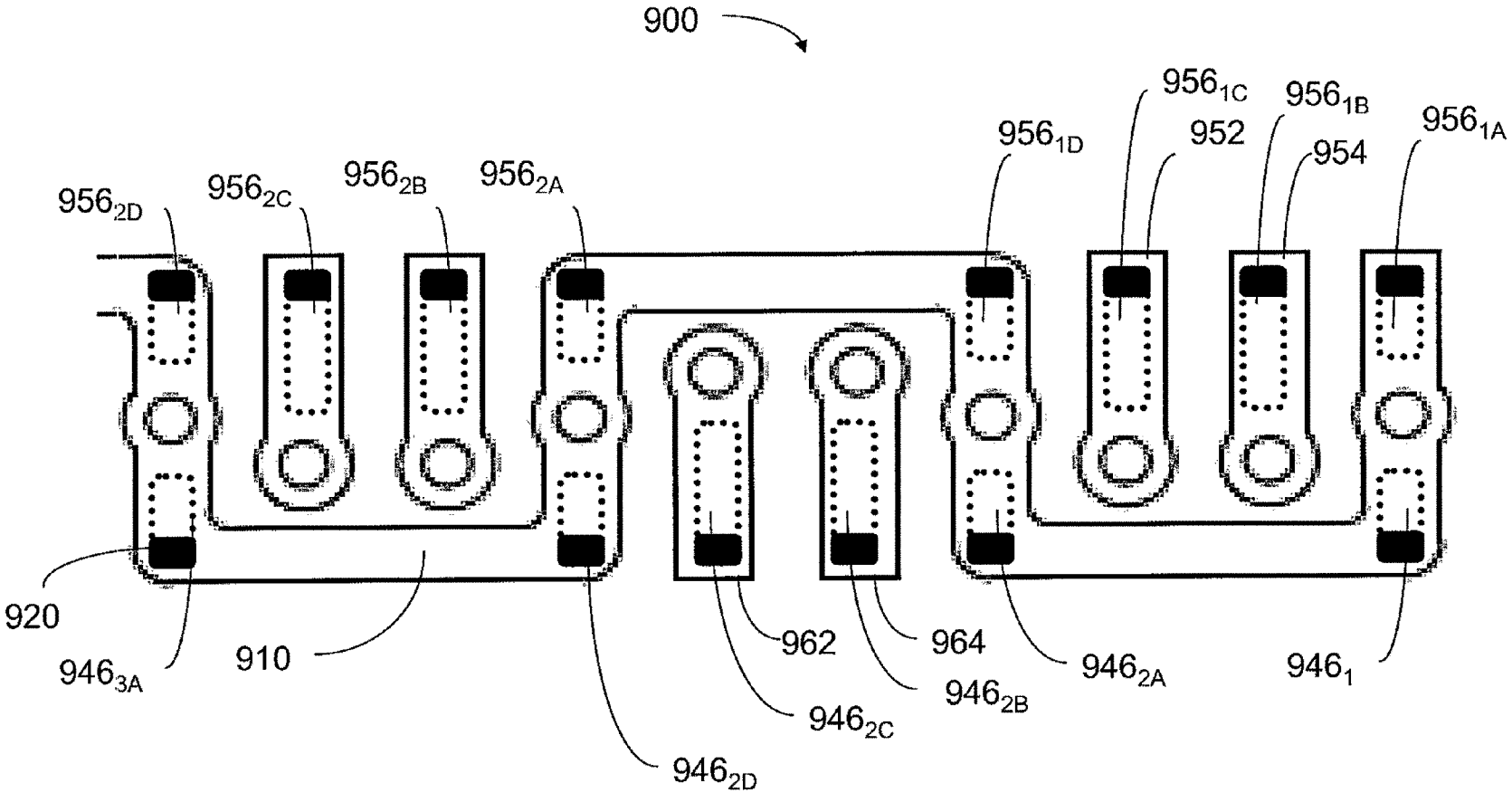
FIG. 9B is an enlarged top view of a portion of the connector footprint of FIG. 9A showing regions of contact according to some embodiments of the present invention.

In one illustrative embodiment, FIG. 9B shows a closer view of a portion of footprint pattern 900 with contact regions $\mathbf{946}_1$, $\mathbf{946}_{2A}$, $\mathbf{946}_{2B}$, $\mathbf{946}_{2C}$, $\mathbf{946}_{2D}$, and $\mathbf{946}_{3A}$, corresponding to regions where a set of contact tails in one column connect to pads of footprint 900. Contact regions $\mathbf{956}_{1A}, \ldots, \mathbf{956}_{1D}$, and $\mathbf{956}_{2A}, \ldots, \mathbf{956}_{2D}$, indicate where contact tails in another column may be connected to pads of the footprint. In this respect, shorter contact regions $\mathbf{946}_1$, $\mathbf{946}_{2A}$, $\mathbf{946}_{3A}$, $\mathbf{956}_{1A}$, $\mathbf{956}_{1D}$, $\mathbf{956}_{2A}$, and $\mathbf{956}_{2D}$ that lie on ground conductor mounting pad 910 correspond to ground contact tails. Similarly, longer contact regions $\mathbf{946}_{2B}$, $\mathbf{946}_{2C}$, $\mathbf{956}_{1B}$, $\mathbf{956}_{1C}$, $\mathbf{956}_{2B}$, and $\mathbf{956}_{2C}$ that lie on signal conductor mounting pads correspond to signal contact tails.

As described previously, contact tails may be soldered to pads in the appropriate footprint pattern. Because contact tails exhibit a curved feature adjacent to the flat portion of the tail, an accumulation of solder, or solder heel, may occur in proximity to the curved feature. In this regard, solder heels 920, shown in FIG. 9B, are depicted as the black areas of the contact regions on the footprint. Accordingly, the flat portions of the contact tails that come into electrical communication with the footprint are given by an approximate area bounded by the dotted outline. As can be seen in FIG. 9B, the contact tails are oriented on the pads of footprint 900 so that the distal portion of each contact tail is adjacent the via for the pad. In other words, the solder heel is positioned at an opposite end of the signal pads from the vias that couple the signal pad to conductive traces within the printed circuit board on which footprint 900 is formed.

This configuration may be desirable for high frequency signals because it reduces abrupt changes in direction of current flow through the signal conductors. Abrupt changes in a conducting structure can be undesirable because they can introduce signal reflections, which reduce signal integrity. As shown, a signal propagating from a via will transition to a surface mount pad associated with that via. The signal can enter a contact tail of a signal conductor soldered to the pad and continue to propagate in the same general direction. In the vicinity of the heel, the signal may transition smoothly through the curved portion of the contact tail into the orientation of the intermediate portion of the signal conductor within the connector attached to contact tail 900.

A similar mounting arrangement is also used for ground conductors. Abrupt changes in the direction of current flow in a ground path can also result in undesirable effects on electrical properties, such as a non-uniform inductance.

Figure 9C:
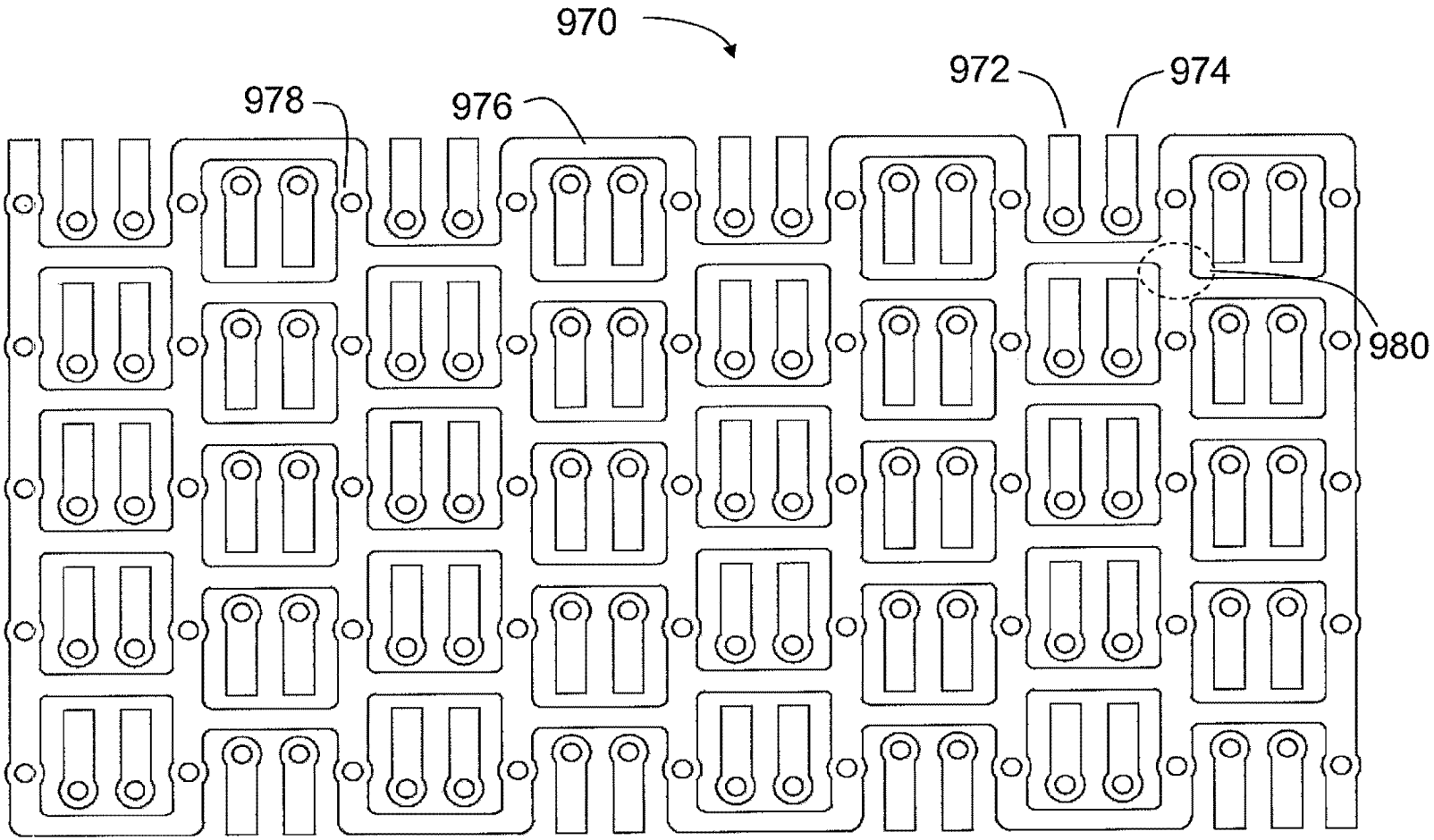
FIG. 9C is a top view of a connector footprint according to some alternative embodiments of the present invention.

FIG. 9C illustrates a connector footprint on a surface of a printed circuit board according to some alternative embodiments. As with footprint 900 (FIG. 9A), footprint 970 includes signal pads (of which signal pads 972 and 974 are numbered) and ground pads (of which ground pad 976 is numbered) that wind around the signal pads in a serpentine pattern. The signal pads are electrically connected to signal conductors within the printed circuit board through vias (not numbered) passing through the signal pads. Ground pads are similarly connected to ground conductors within the printed circuit boards (of which ground via 978 is numbered).

Footprint 970 differs from footprint 900 in that ground pads, such as ground pad 976, are formed with straps that interconnect what are shown as separate ground pads in the embodiment of FIG. 9A. In the embodiment of FIG. 9C, ground pad 976 in region 980 has such a strap. Such a strap may aid the ground pad in resisting separating from the printed circuit board when stress is placed on a connector soldered to footprint 970.

In the embodiment illustrated, the strap joins ground pads to which contact tails of adjacent wafers are soldered. As illustrated, the addition of a strap makes a unitary ground pad that winds around pairs or signal pads in both the row and column directions of the footprint.

In comparison to footprint 900, such straps eliminate corners of ground pad 976 adjacent contact regions $\mathbf{946}_1$, $\mathbf{946}_{2A}$, $\mathbf{946}_{3A}$, $\mathbf{956}_{1A}$, $\mathbf{956}_{1D}$, $\mathbf{956}_{2A}$, and $\mathbf{956}_{2D}$ where contact tails of ground contacts are soldered. By eliminating such corners adjacent to locations where contact tails from a connector are soldered to the contact pad, the propensity of the pad to separate from the printed circuit board as force is placed on the connector is reduced.

In yet other embodiments, a ground pad may be further strengthened by inclusion of vias in locations where separation is likely to occur. Because the ground pads aid in securing the pad to the printed circuit board, such vias provide additional mechanical strength to the pad. The additional vias could be in the form of vias 978, which may be through hole vias making connection to conductive elements within the printed circuit board. However, the additional vias may not be necessary for electrical connection of the pad to a structure within the printed circuit board. In such embodiments, smaller vias, sometimes called microvias may be used. In contrast to ordinary vias that have an aspect ratio that allows the inside walls of the via to be plated during manufacture, microvias may not pass all the way through the board. A microvia, for example, may extend only to the first ground layer within the printed circuit, which may be near the surface of the printed circuit board. Accordingly, the microvias extend into a printed circuit board less than vias and can have a smaller diameter to maintain an aspect ratio required to plate the inside of the vias. For example, a via may have a diameter on the order of 0.010 inches (0.25 mm), but a microvia may have a diameter of less than 0.05 inches (0.13 mm). Though any suitable attachment mechanism may be used, microvias may be used in some embodiments because they interfere less with routing of conductive traces of the printed circuit board than traditional vias.

Figure 9D:
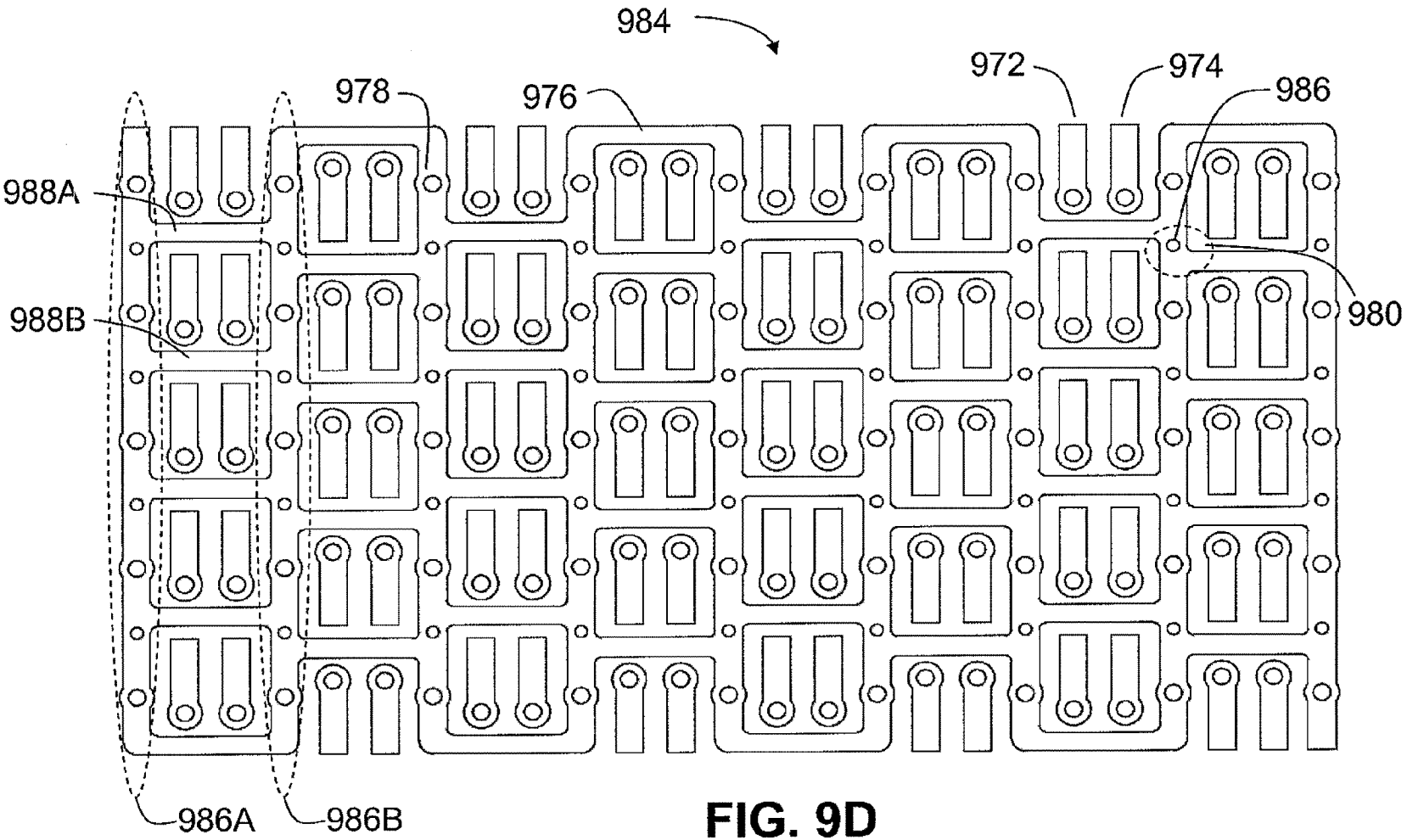
FIG. 9D is a top view of a connector footprint according to some alternative embodiments of the present invention.

FIG. 9D illustrates an embodiment in which microvias (of which microvia 986 is numbered) are incorporated. In the embodiment illustrated, the microvias are incorporated into region 980 and are therefore adjacent attachment locations for contact tails from ground conductors of a connector wafer attached to footprint 984. This positioning also interleaves conventionally sized vias (of which via 978 is numbered) and microvias along stripes (of which stripes 968A and 968B are numbered) of ground pads along rows of the footprint. In the embodiment illustrated, contact tails from ground conductors in multiple wafers in the connector may be soldered to such a stripe. Because the contact tails for the ground conductors within the connector are attached to such stripes, the additional mechanical strength obtained by attaching this stripe with multiple vias, some of which may be microvias, improves the mechanical integrity of the connector attachment.

In some embodiments, a foot print may be implemented with ground pads with parallel stripes, such as stripes 986A and 986B, without transverse portions, such as portions 988A and 988B interconnecting the stripes.

Figure 10:
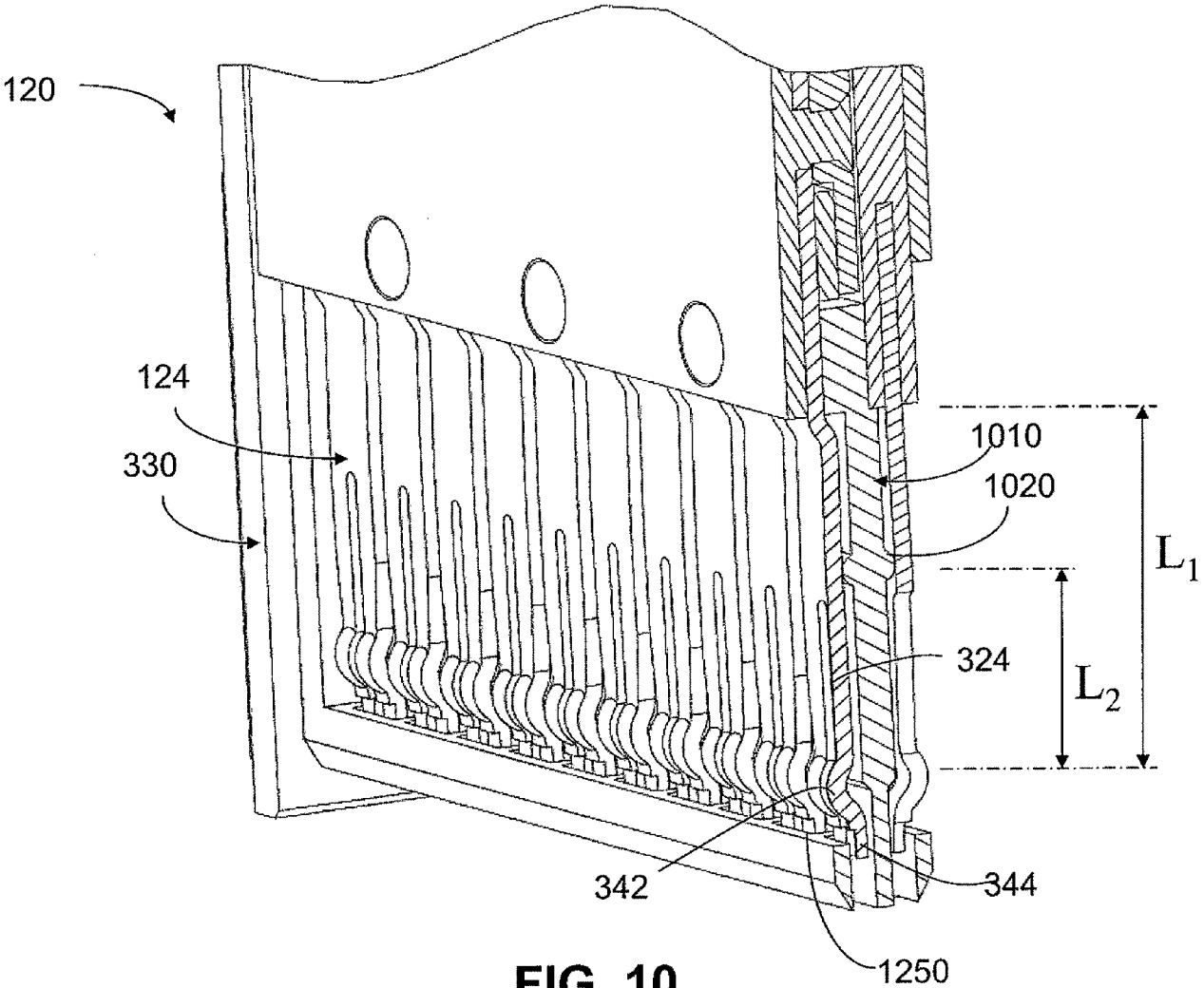
FIG. 10 is a perspective view, partially cut away, of the mating portion of the daughter card wafer subassembly of FIG. 3.

Turning now to FIG. 10, additional detail of a forward mating portion of wafer subassembly 120 is shown. A section profile of the mating contacts 124 in connection with front wafer housing 330 is depicted in FIG. 10. In this regard, mating contacts 124 may be configured as dual beam contacts 324 in which the ends have a curved portion 342 having a mating contact surface on the convex surface. The distal end 344 of each mating contact portion fits into a slot 1250 located on front wafer housing 330.

In addition, front wafer housing 330 includes a midpiece 1010 that separates mating contacts 324 on opposing sides from one another. In this regard, mating contacts 124 are faced outwardly from the midpiece 1010 that separates them. It can be appreciated that midpiece 1010 may be formed of any suitable insulative material. Accordingly, midpiece 1010 has surfaces that form insulative walls behind each column of mating contact portions of the conductive elements of the daughter card wafer subassembly.

With regard to the mating contacts 124, each of the beams includes a mating surface that allows for a reliable electrical connection between a conductive element in the wafer subassembly 120 and a corresponding conductive element in backplane wafer subassembly 140 to be formed. The beams may be shaped to press against a corresponding mating contact in the backplane wafer subassembly 140 with sufficient mechanical force to create a reliable electrical connection. Having two beams per contact increases the likelihood that an electrical connection will be formed even if one beam is damaged, contaminated or otherwise precluded from making an effective connection.

Each of the beams may also have a shape that generates mechanical force for making an electrical connection to a corresponding contact. When a backplane and daughter card connector are in a mated configuration, this mechanical force urges the contact surfaces of a daughter card wafer subassembly against a corresponding contact surface in a backplane connector. This force, sometimes called the retention force, should be large enough to make a reliable electrical connection, despite contamination on either contact surface and despite forces that may tend to separate the contact surfaces, such as those caused by vibration of an electronic system containing a connector.

However, the retention force should not be too large. The same pressing motion of the beams of one connector against mating contact portions of a mating connector also contributes to the insertion force required to press the connectors into a mated configuration. A high insertion force can make it difficult to insert a daughter card into an electronic assembly. In addition, there can be other negative effects associated with a high insertion force, such as a greater risk of damage to the connectors or other components of the assembly if there is misalignment as the daughter card is inserted into an electronic assembly with a high force.

Because the force required to insert a daughter card into an electronic assembly may depend on the total number of mating contacts, it may be necessary to limit the force with which the beams of the daughter card subassembly press against mating contacts, particularly if there are a large number of mating contacts in the daughter card connector. Conventionally, the desire for a high retention force is balanced against the desire for a low insertion force.

In some embodiments, a connector may include a mechanism to achieve both a high retention force and a low insertion force by varying the spring rate each of the mating contact portions during a mating sequence. Variations in spring rate may be achieved by effectively changing the beam length of beams carrying mating contact surfaces during the mating of two connectors. In FIG. 10, the effective length of dual beam contacts 324 changes from an initial effective length of $L_1$ to an effective length of $L_2$. Because the spring rate a deflected beam is inversely proportional to the effective length of the beam, changing the length of the beam can change the spring rate.

In the illustrated embodiment, the effective length of the beam may be changed during the mating sequence by including a projection adjacent the beam. As shown in FIG. 10, midpiece 1010 includes a protrusion 1020. In this embodiment, protrusion 1020 projects from a portion of midpiece 1010. As can be seen in FIG. 10, protrusion 1020 is offset from the slots 1250 at the forward edge of front housing 330 in a direction along the elongated dimension of the mating contact portions.

In the embodiment illustrated, protrusion 1020 extends from both opposing surfaces of midpiece 1010 such that a portion of projection 1020 extends from midpiece 1010 towards each column of conductive elements. In this embodiment, each column of conductive contact elements may exhibit substantially the same insertion force. Though, it is not required that both sides of midpiece 10101 be the same.

Here, protrusion 1020 has a half cylindrical portion extending above the surface of midpiece 1010. Though, a protrusion of any suitable shape may be used.

The distal tips of the compliant beams that form mating contact portions may be retained in slots 1250. Though, as noted above, the contacts 324 may be formed so that the distal tips of the contacts are biased outwards from midpiece 1010. Accordingly, when in an unmated position, contact 324 will be held away from protrusion 1020.

When daughter card connector 102 and backplane connector 104 are unmated, contacts 324 are separated from protrusion 1020 and a forward surface of rear wafer housing 310 (FIG. 3) through which the contacts 324 defines a deflection point for the contacts 324. As a result, each of the contacts 324 can deflect over the full length $L_1$ of the mating contact portion extending from the housing of daughter card subassembly 120.

During the first stage of a mating sequence, contacts 324 provide spring rate inversely proportional to the length $L_1$, resulting in a relatively low insertion force. As the mating sequence proceeds, the mating surfaces of contacts 324 will eventually engage surfaces in a backplane connector, which will deflect the contacts 324 towards midpiece 1010. As the mating contacts 324 press against protrusion 1020, they deflect at a deflection point defined by the position of protrusion 1020. Accordingly, the contacts 324 deflect only over the length $L_2$, effectively shortening the beam length. With this shorter beam length, the spring rate and therefore the force exerted by contacts 324 against portions of the backplane connector is increased.

Figure 11:
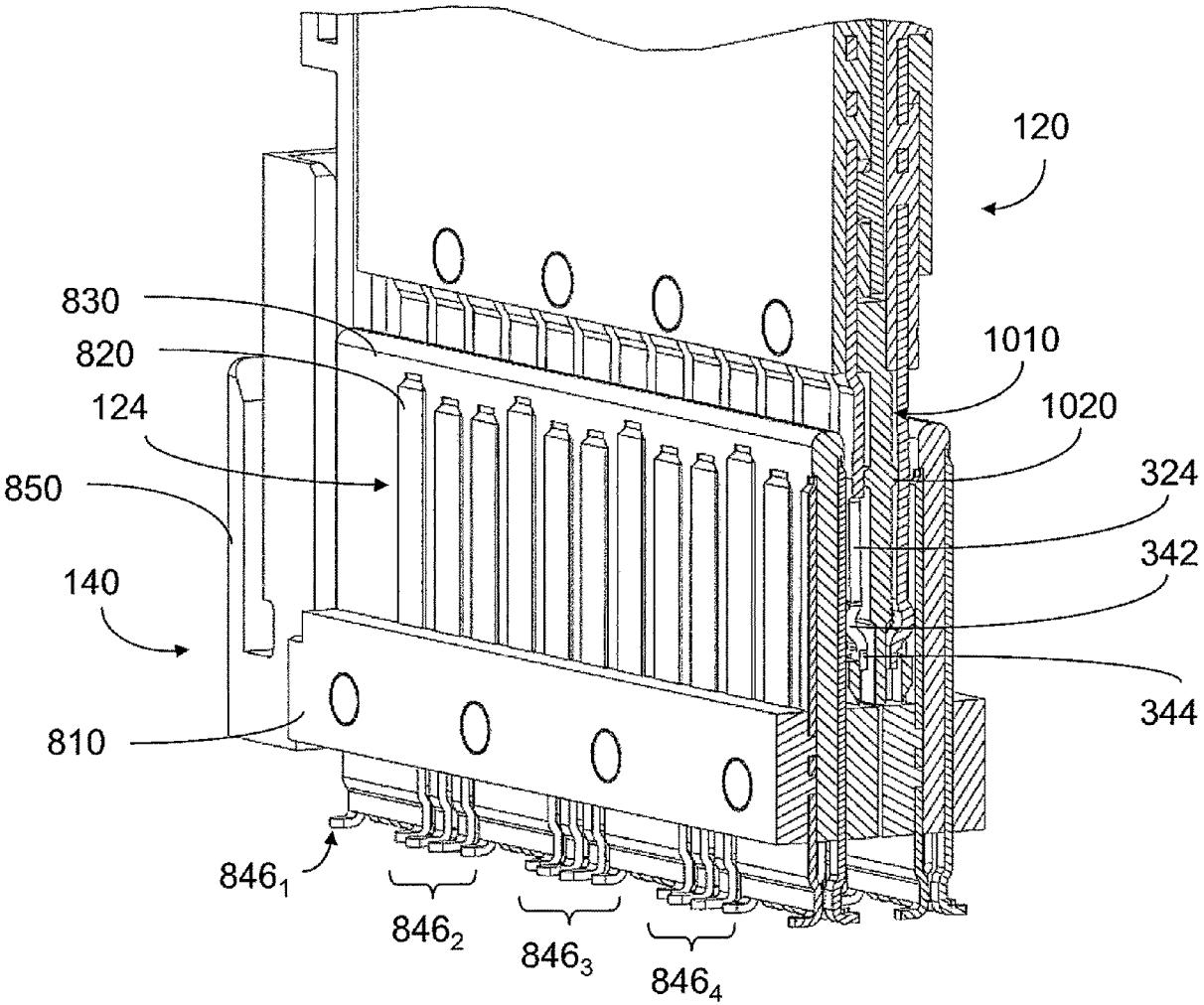
FIG. 11 is a perspective view, partially cut away, of a daughter card wafer subassembly mated with a backplane subassembly according to some embodiments of the present invention.

At the end of the mating sequence, illustrated in FIG. 11 with a section profile, contacts 324 press against mating contact portions of backplane wafer subassemblies 140 with a retention force greater than the initial insertion force by an amount that reflects the increased spring rate.

A connector according to embodiments of the invention may be designed to provide desired forces. The materials used to form the compliant mating contact portions as well as the position of a projection along the length of the compliant contact may be varied to adjust the initial insertion force and the retention force. As a specific example, the initial spring rate per contact may be in the range of 1 to 6 grams per mil of deflection (40 gm/mm to 250 gm/mm). In some embodiments, the initial spring rate per contact may be approximately 4 gm/mil (160 gm/mm). In contrast, the retention force per contact may be generated by a spring rate in the range of 7-12 gm per mil of deflection (290 to 490 gm/mm). In some embodiments, the spring rate per contact while generating the retention force may be approximately 8 to 9 gm/mil (325 to 370 gm/mm).

FIG. 11 also illustrates the alignment of respective daughter card wafer subassemblies 120 and backplane wafer subassemblies 140. As shown, the mating surfaces of conductive members on each of the subassemblies face outwards. Also as illustrated, both of the subassemblies include mating contact portions on two opposing surfaces. With this configuration, the mating contact portions on each side of a daughter card wafer subassembly press against the mating contact portions of an adjacent backplane wafer subassembly. Consequently, each daughter card wafer subassembly 120 fits between and mates with two backplane wafer subassemblies.

This outward facing orientation of contacts ensures that both daughter card wafer subassemblies and backplane wafer subassemblies have a central portion that provides mechanical support. As illustrated, daughter card wafer subassembly 120 includes midpiece 1010. Similarly, each backplane wafer subassembly 140 includes a housing portion 830 that has mating contacts on two surfaces.

This mechanical support can reduce deformation of the connector during attachment to a printed circuit board. In the embodiment illustrated, the connectors include surface mount contact tails. Such connectors are attached using a reflow solder process. In a reflow process, solder paste in deposited on pads of a footprint, such as footprint 900 (FIG. 9A). The connector is placed on the printed circuit board, with contact tails in the solder paste. The printed circuit board, including the solder paste and the connector, are then heated to a sufficiently high temperature to cause the solder paste to melt. When the board is allowed to cool, the solder fuses the contact tails to the pads.

During heating for reflow soldering, thermoplastic materials forming the connector housing can soften and weaken. For lead-free solder, a higher reflow temperature may be required, increasing the risk that the connector housing will soften and weaken. However, because of the relatively substantial mid-portions of both daughter card wafer subassembly 120 and backplane wafer subassembly 140 that results from a mid-portion with columns of contacts on each side, the risk of deformation is reduced. Reducing risk of deformation can be particularly important in a connector that includes biased beams, such as dual beams 324. As noted above, the beams are biased outwards from the connector housing. This biasing provides an additional range of motion for the contact elements, increasing the likelihood of reliable connection. However, to avoid damage to the beams during mating, a distal ends of the beams are retained within the housing. As illustrated in FIG. 10, the tips of the beams may be retained in slots 1250. As can be seen in FIG. 10, the slots 1250 are formed integrally with the relatively substantial mid-portion 1010. As the connector is heated during a reflow operation, even though the beams assert a force against a portion of the housing, the likelihood that such a force with deform the housing is reduced.

FIG. 10 illustrates a further reason that the likelihood of deformation of the connector housing during surface mounting is reduced. As can be seen in FIG. 10, each wafer subassembly with compliant beams contains two columns of compliant beam contacts. Each column asserts an outward force on the mid-portion 1010. As a result, the two columns of compliant beams in each wafer sub-assembly assert approximately equal, but opposite, forces on the mid portion 1010. The balanced forces reduce the likelihood of deformation, even if a connector housing softens during a reflow operation.

Figure 12:
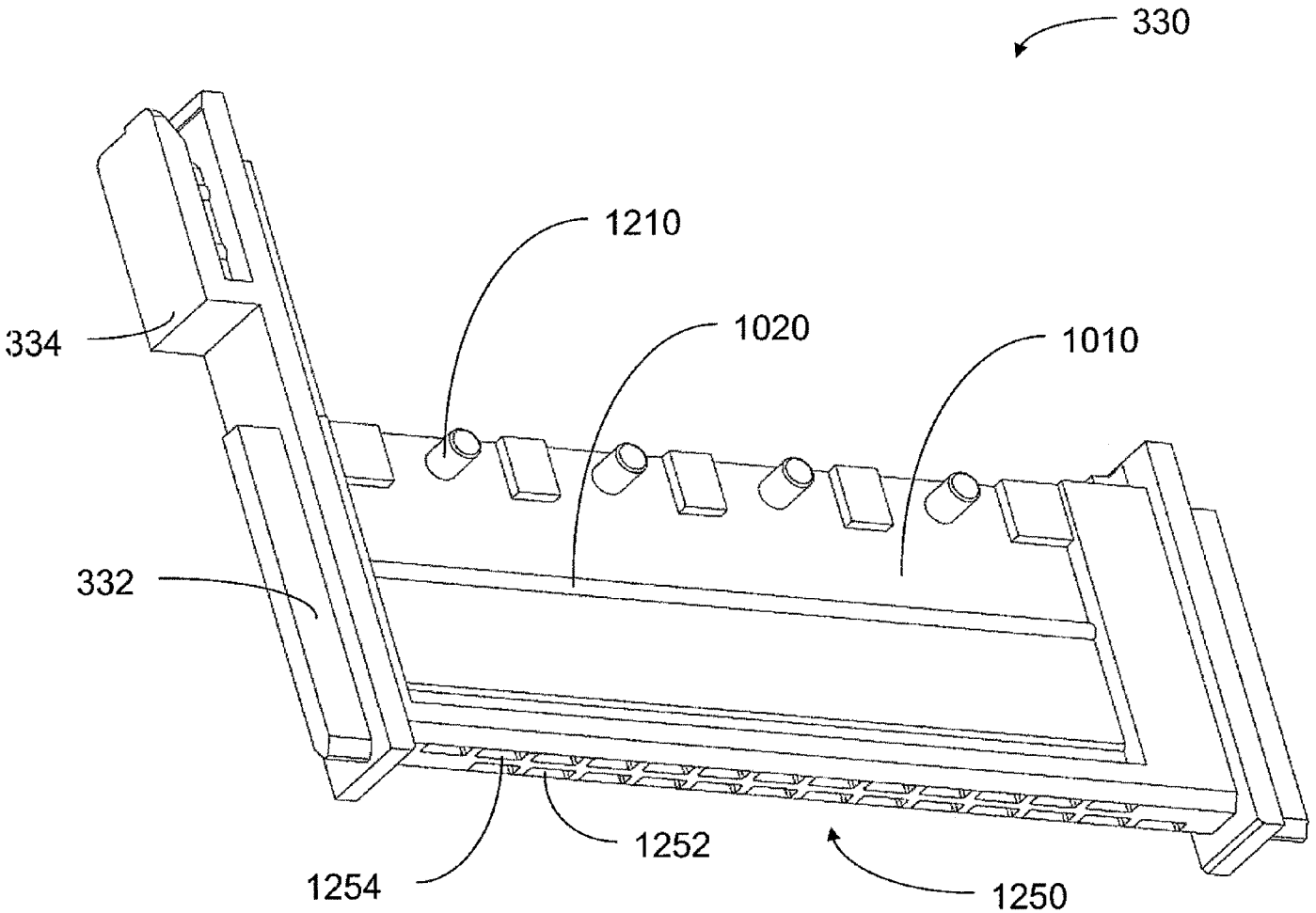
FIG. 12 is a perspective view of a front housing portion of a daughter card wafer subassembly according to some embodiments of the present invention.
Figure 13:
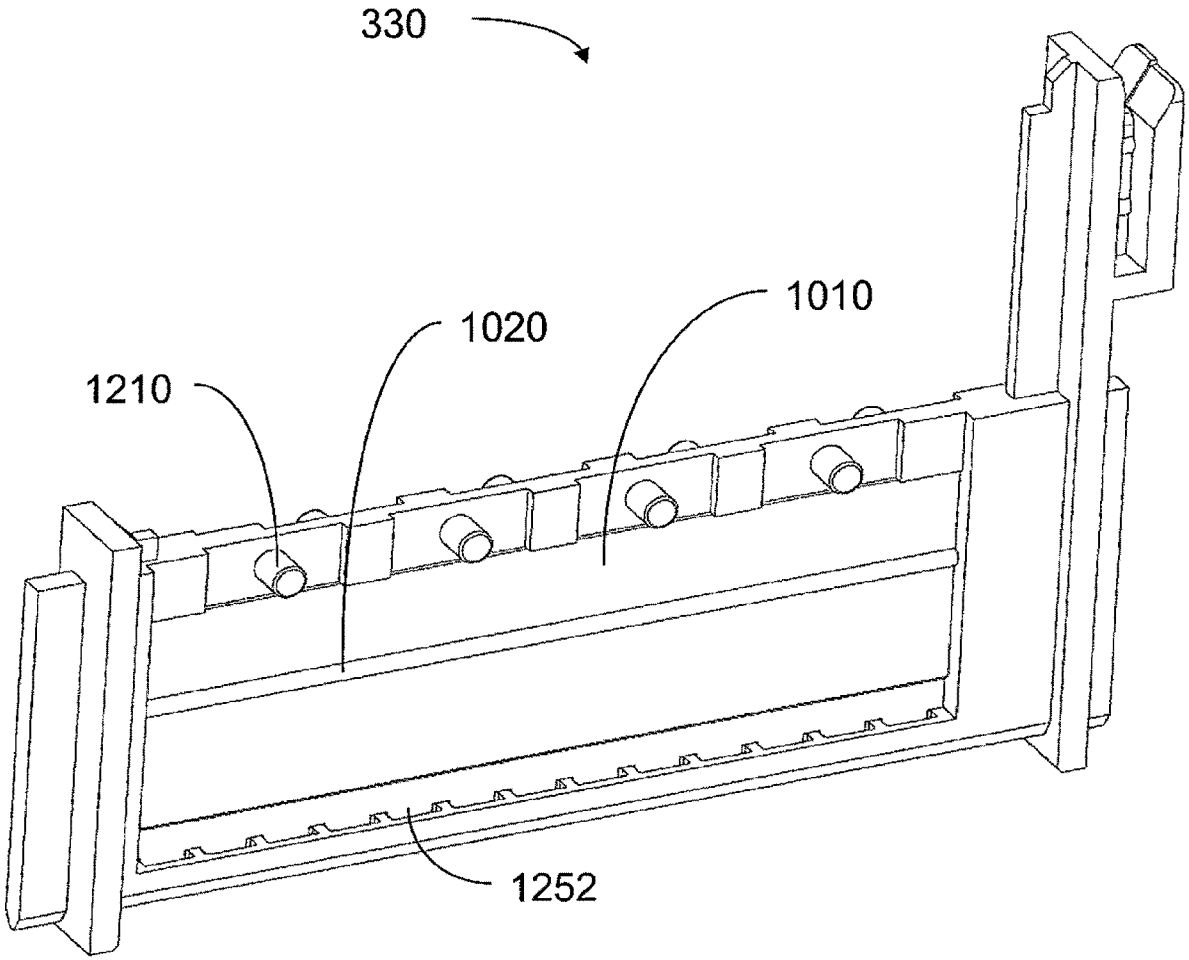
FIG. 13 is a different perspective view of the front housing portion of FIG. 12.

Turning to FIGS. 12 and 13 additional detail of daughter card front wafer housing 330. In this view, midpiece 1010 can be seen as well as protrusion 1020 that runs along the midpiece 1010. FIGS. 12 and 13 show protrusions 1020 running across opposing surfaces of midpiece 1010. In this embodiment, each protrusion is positioned to be adjacent to a column of contacts 324 when a daughtercard wafer subassembly is formed. Though shown as a single piece, protrusion 1020 could alternatively formed in other configurations. For example, protrusion 1020 could be segmented, with a separate segment adjacent each contact 324 in a column.

FIGS. 12 and 13 also reveal other features of front housing portion 330 according to some embodiments. Attachment pins 1210 are shown, which allow for a secure connection to occur between front wafer housing 330 and conductor wafers 410 and 420. Also visible are slots 1250 located along the forward, mating edge of front wafer housing 330, as previously discussed. In this regard, distal ends 344 of mating contacts 124 may be inserted into slots 1250 in order to keep contact pairs 324 from "stubbing" or being damaged when a daughter card and backplane connector are mated.

As illustrated by bottom perspective view FIG. 12, slots 1250 may be divided along midpiece 1010 into a group of slots 1252 for one side and a group of slots 1254 for the other side. A top perspective view FIG. 13 shows that midpiece 1010 effectively separates slots 1252 from slots 1254. In this respect, mating contacts 124 located on opposite sides of front wafer housing 330 are outwardly facing.

Figure 14:
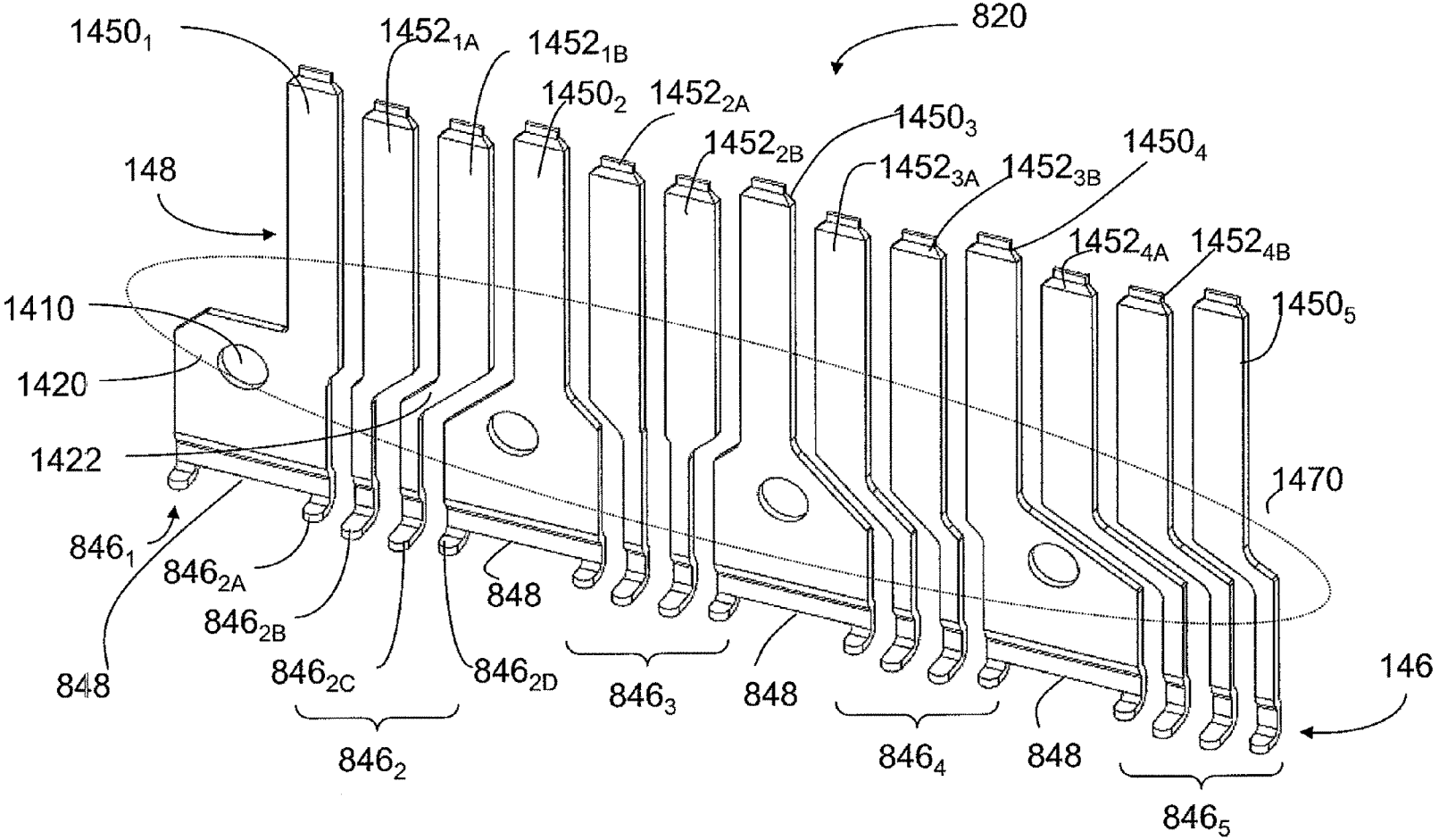
FIG. 14 is a perspective view of a lead frame piece of a backplane sub-assembly according to some embodiments of the present invention.

Additional details of the backplane wafer assembly are illustrated in FIG. 14. As indicated above in connection with FIG. 8, each backplane wafer sub-assembly includes two columns of conductive elements. Each of the columns may be formed from a lead frame stamped from a sheet of conductive metal, though any suitable construction technique may be employed.

FIG. 14 illustrates that lead frame 820 is formed to provide a repeating pattern of signal conductors $\mathbf{1452}_{1A}$, $\mathbf{1452}_{1B}$ . . . $\mathbf{1452}_{4A}$, $\mathbf{1452}_{4B}$ and ground conductors $\mathbf{1450}_1$ . . . $\mathbf{1450}_5$ along the column. The signal conductors are disposed in pairs, with a ground conductor adjacent to each pair, leading to a repeating pattern of ground conductors.

In the embodiment illustrated, each column may be formed of a lead frame with the same shape, but within each backplane wafer sub-assembly, the lead frames are mounted with opposite orientations such that the mating contact portions are outwardly facing on both sides of the wafer subassembly. Because of the different orientation on different sides of the wafer subassembly, the repeating pattern of signal and ground conductors starts at opposite ends of adjacent columns.

FIG. 14 illustrates lead frame 820 without backplane connector housing portion 810. In this regard, mating contacts 148 are shown with ground mating contact $\mathbf{1450}_1$ . . . $\mathbf{1450}_5$ and signal mating contact $\mathbf{1452}_{1A}$ . . . $\mathbf{1452}_{4B}$. In this case, ground mating contacts $\mathbf{1450}_1$ . . . $\mathbf{1450}_5$ are longer than signal mating contacts $\mathbf{1452}_{1A}$ . . . $\mathbf{1452}_{4B}$.

In the embodiment illustrated, the mating contact portions 148 of the conductive elements in lead frame 820 have a uniform pitch. The center-to-center spacing of the mating contacts 148 aligns with the center-to-center spacing of the corresponding mating contact elements, which in the example embodiment may be beams 324 in the daughtercard connector. The mating contact tails for the conductive elements align with the pads in backplane footprint 152. As can be seen in FIG. 14, the spacing between contact tails may be different than the spacing between mating contact portions 148.

Further, the mating contact tails appear in groups, such as $\mathbf{846}_1$ . . . $\mathbf{846}_5$ with different spacing between the contact tails within each group than between each group.

Further, the ground conductive elements include relatively large segments including plates 848 in the vicinity of mating contact tails. This configuration is achieved through a transition region 1470 of the intermediate portions of the conductive elements in which both the spacing and width of contact elements in lead frame 820 may transition from the uniform spacing and width of the mating contact region to the non-uniform spacing and width in the intermediate and contact tail sections.

In contrast to a conventional backplane connector in which conductive elements generally pass straight through a connector housing in a plane perpendicular to the surface of a backplane, transition region 1470 facilitates a backplane connector design that provides high density along with improved electrical and mechanical integrity. Additionally, the configuration of lead frame 820 allows a backplane wafer sub-assembly with oppositely facing contacts on two opposing surfaces to be formed with two copies of the same component design to implement two lead frames.

Additional details of the design of lead frame 870 are also visible in FIG. 14. Attachment hole 1410 may be included for a structural connection to be made with backplane connector housing portion 810. Hole 1410 passes through a wide and therefore has little impact in signal covered through lead from 820.

FIG. 14 shows that contact tails 146 may be divided into groups $\mathbf{846}_1$, . . . , $\mathbf{846}_5$. In this regard, ground region 1420 is shaped into a body that spans two ground contact tails $\mathbf{846}_1$ and $\mathbf{846}_{2A}$. Region 1420 is sized so that tails of the signal conductors, here those in group $\mathbf{846}_5$, will fit between contact tails $\mathbf{846}_1$ and $\mathbf{846}_{2A}$, when a second lead frame in the shape of lead frame 820 is mounted adjacent to it.

Thus, it will be appreciated that an electrical connector in which the spring rate of the contacts generating the insertion force increases during the mating cycle may be provided. In such a connector, initially, the spring rate may be relatively low. The spring rate increases as the connector is almost fully mated. As a result, the retention force is relatively high. A changing spring rate reduces the possibility of damage to the connector because lower force can be used during the early part of the mating cycle when connector could be misaligned with a mating connector and is most susceptible to damage from a high insertion force. The increase in spring rate after initial connector alignment can be achieved through the use of beam-shaped mating contacts, each held in a housing. The mating contacts have outwardly facing mating surfaces, which deflect towards the housing upon mating. The housing is shaped so that a projection from the housing contacts each beam as it bends towards the housing during the mating cycle. The projection shortens the effective length of the beam, increasing the spring rate of the beam.

Also, an interconnection system using surface mount electrical connectors that can withstand the heat of a reflow process, even for relatively high temperatures used with lead-free solder may be provided. In such an interconnection system, the connectors are assembled from wafer subassemblies that have outwardly facing contact surfaces, avoiding the need for relatively thin walled cavities that could deform during a reflow operation. Subassemblies in a daughter card connector contain conductive elements with beams forming mating contact portions. The beams are biased to press outwards from the subassembly housing, but a ledge on each side of a central portion of the housing retains the tips of the mating contact portions. The force exerted on the housing by the mating contact portions is balanced, reducing the likelihood that the housing will deform if housing material softens during reflow. A mating backplane connector is also assembled from wafers, with each wafer having a central portion carrying mating contact portions on two sides. Each daughter card subassembly fits between and mates with two halves of adjacent backplane subassemblies.

Also, a backplane connector with conductive elements having transition regions that allow for a change in the size and spacing of conductive elements between a mating contact portion and a contact tail may be provided. As a result of the transition, the mating contact portions can be positioned on a uniform pitch to align with conductive elements in a daughter card connector, but the contact tail portions of the conductive elements can be shaped to improve signal integrity or to provide a more compact footprint. In the transition regions, ground conductors may be wider than signal conductors. Also, the transition regions may be used to provide column to column alignment such that pairs of signal conductors align with the wide portions of ground conductors in adjacent columns. Despite the column to column alignment of signal and ground conductors, the same lead frame may be used to form all columns, with a different attachment orientation in each column.

Further, an interconnection system with a connector mounting providing improved signal integrity. Connectors of the interconnection system are formed of subassemblies that each have two columns of conductive elements. Along each column, pairs of signal conductors are interspersed with ground conductors. The ground conductors have two contact tails with a planar portion in between. The columns are configured such that the contact tails of the ground conductors align from column to column, but the planar portions of the ground conductors in one column align with a pair of signal conductors in the other column. As a result, the grounding configuration that exists within the connector continues into the mounting area of the connector. Additionally, ground contacts from adjacent columns can be mounted to the same pad on a printed circuit board, creating a compact footprint. The ground pads for mounting each subassembly can be merged into a continuous pad that winds around pads for signal conductors, providing both shielding and mechanical strength that resists pad delamination.

Having thus described several aspects of at least one embodiment of this invention, it is to be appreciated various alterations, modifications, and improvements will readily occur to those skilled in the art.

As one example, a connector designed to carry differential signals was used to illustrate selective placement of material to achieve a desired level of delay equalization. The same approach may be applied to alter the propagation delay in signal conductors that carry single-ended signals.

Further, although many inventive aspects are shown and described with reference to a daughter board connector, it should be appreciated that the present invention is not limited in this regard, as the inventive concepts may be included in other types of electrical connectors, such as backplane connectors, cable connectors, stacking connectors, mezzanine connectors, or chip sockets.

As a further example, connectors with four differential signal pairs in a column were used to illustrate the inventive concepts. However, the connectors with any desired number of signal conductors may be used.

Also, though embodiments of connectors assembled from wafer subassemblies are described above, in other embodiments connectors may be assembled from wafers without first forming subassemblies. As an example of another variation, connectors may be assembled without using separable wafers by inserting multiple columns of conductive members into a housing.

Also, impedance compensation in regions of signal conductors adjacent regions of lower dielectric constant was described to be provided by altering the width of the signal conductors. Other impedance control techniques may be employed. For example, the signal to ground spacing could be altered adjacent regions of lower dielectric constant. Signal to ground spacing could be altered in an suitable way, including incorporating a bend or jag in either the signal or ground conductor or changing the width of the ground conductor.

Additionally, lossy material may be selectively placed within the insulative portions of backplane wafer subassembly 140 to reduce crosstalk, without providing an undesirable level attenuation for signals. Further, adjacent signals and grounds may have conforming portions so that in locations where the profile of either a signal conductor or a ground conductor changes, the signal-to-ground spacing may be maintained.

In the embodiments illustrated, some conductive elements are designated as forming a differential pair of conductors and some conductive elements are designated as ground conductors. These designations refer to the intended use of the conductive elements in an interconnection system as they would be understood by one of skill in the art. For example, though other uses of the conductive elements may be possible, differential pairs may be identified based on preferential coupling between the conductive elements that make up the pair. Electrical characteristics of the pair, such as its impedance, that make it suitable for carrying a differential signal may provide an alternative or additional method of identifying a differential pair. For example, a pair of signal conductors may have an impedance of between 75 Ohms and 100 Ohms. As a specific example, a signal pair may have an impedance of 85 Ohms+/−10%. As another example of differences between signal and ground conductors, in a connector with differential pairs, ground conductors may be identified by their positioning relative to the differential pairs. In other instances, ground conductors may be identified by their shape or electrical characteristics. For example, ground conductors may be relatively wide to provide low inductance, which is desirable for providing a stable reference potential, but provides an impedance that is undesirable for carrying a high speed signal.

Also, ground conductors of daughtercard wafers are not shown with generally wide planar portion like planar portions $\mathbf{848}_6$ in the backplane wafer subassembly. However, the ground conductors of the daughtercard wafers are shown with two contact tails conductive element are planar portions, like planar portions $\mathbf{848}_5$ could be incorporated in the daughtercard wafers too. Such alterations, modifications, and improvements are intended to be part of this disclosure, and are intended to be within the spirit and scope of the invention. Accordingly, the foregoing description and drawings are by way of example only.

What is claimed:

1. An electrical connector, the connector comprising:

at least one insulative wall, the insulative wall having at least one protrusion extending therefrom; and a plurality of conductive elements each having a mating contact portion, the mating contact portion comprising a compliant member, the compliant member being adapted and configured to have a first position when the connector is mated with a mating connector and a second position when the connector is un-mated from the mating connector, wherein the at least one protrusion is sized and positioned such that each mating contact portion contacts a protrusion of the at least one protrusion when in the first position and each mating contact portion is spaced from the at least one protrusion when in the second position.

2. The electrical connector of claim 1, wherein:

each of the mating contact portions is elongated in a first direction and has an end;

the at least one insulative wall comprises a portion of a housing, the housing having at least one ledge restraining the end of the mating contact portion of each of the plurality of conductive elements when the mating contact portion is in the second position; and the at least one protrusion is offset in the first direction from the at least one ledge.

3. The electrical connector of claim 2, wherein the plurality of conductive elements are disposed in a column.

4. The electrical connector of claim 3, wherein each of the plurality of conductive elements comprises a curved portion defining a mating contact surface facing away from the insulative wall.

5. The electrical connector of claim 4, wherein:

the plurality of conductive elements disposed in the column comprises a first column of conductive elements;

the insulative wall comprises a first insulative wall;

and the at least one protrusion comprises at least one first protrusion; and the connector comprises:

a second insulative wall, the insulative wall having at least one second protrusion extending therefrom; and a second column of conductive elements, each having a mating contact portion, the mating contact portion comprising a compliant member, the compliant member being adapted and configured to have a third position when the connector is mated with the mating connector and a fourth position when the connector is un-mated from the mating connector;

wherein the at least one second protrusion is sized and positioned such that each second mating contact portion contacts a protrusion of the at least one second protrusion when in the third position and each mating contact portion is spaced from the at least one second protrusion when in the fourth position.

6. The electrical connector of claim 5, wherein the first insulative wall and the second insulative wall comprise opposing surfaces of an insulative member.

7. The electrical connector of claim 6, wherein, the mating contact portion of each conductive element in the second column comprises an end portion retained within the insulative member.

8. The electrical connector of claim 7, wherein:

the at least one ledge comprises at least one first ledge and the housing comprises at least one second ledge restraining the end of each of the mating contact portions when the mating contact portion is in the second position;

the housing comprises a front housing portion receiving a first wafer and a second wafer, the first wafer comprising a first wafer housing holding the first column of conductive elements and the second wafer comprising a second wafer housing holding the second column of conductive elements.

9. The electrical connector of claim 1, wherein a spring rate of each of the compliant members of the plurality of conductive elements is greater when the compliant members are in the second position than in the first position.

10. The electrical connector of claim 9, wherein the spring rate ranges between approximately 290 gm/mm and approximately 490 gm/mm when the compliant members of the plurality of conductive elements are in the first position.

11. The assembly of claim 10, wherein the spring rate ranges between approximately 40 gm/mm and approximately 250 gm/mm when the compliant members of the plurality of conductive elements are in the second position.

12. A method of operating an electrical connector comprising a plurality of conductive elements, each conductive element comprising a mating contact portion, the method comprising:

aligning the connector with a mating connector;

moving the connector and the mating connector towards each other over a first distance;

as the connector and the mating connector are moving over the first distance, deflecting each mating contact relative to a first deflection point, the first deflection point being a first length from an end of the mating contact;

further moving the connector and the mating connector towards each other over a second distance; and as the connector and the mating connector are moving over the second distance, deflecting each mating contact relative to a second deflection point, the second deflection point being a second length from the end of the mating contact.

13. The method of claim 12, wherein the second length is less than the first length, whereby the spring rate of the mating contact portions of the connector is greater as the connector and mating connector move towards each other over the second distance than over the first distance.

14. The method of claim 12, wherein:

each of the plurality of mating contacts comprises a dual beam contact extending from a housing by the first distance; and deflecting each mating contact relative to a first deflection point comprises deflecting each mating contact relative to an interface between the dual beam contact and the housing.

15. The method of claim 14, wherein:

the housing comprises a projection adjacent each of the plurality of mating contacts, the projection being positioned adjacent an intermediate portion of the mating contact; and deflecting each mating contact relative to a second deflection point comprises bending the mating contact over the projection.

16. The method of claim 15, wherein deflecting each mating contact relative to the first deflection point and relative to the second deflection point comprise pressing each mating contact portion toward the housing with a mating contact portion from the mating connector.

17. An electrical connector comprising:

a plurality of wafer subassemblies, each wafer subassembly comprising:

a front housing portion comprising:

a first column and a second column, each column comprising at least one cavity, each cavity in the first column and the second column having a rearward opening;

an insulative member between the first column and the second column, the insulative member comprising a first surface adjacent the first column and a second surface adjacent the second column;

at least one first projection on the first surface, the at least one first projection being positioned parallel to and a first distance from the first column; and at least one second projection on the second surface, the at least one second projection being positioned parallel to and a first distance from the second column;

a first wafer, the first wafer comprising a first housing and a first plurality of conductive elements, each conductive element of the first plurality of conductive elements comprising a mating contact portion extending from the first housing by a second distance, the second distance greater than the first distance, and each conductive element comprising an end disposed within a cavity of the first column; and a second wafer, the second wafer comprising a second housing and a second plurality of conductive elements, each conductive element of the second plurality of conductive elements comprising a mating contact portion extending from the second housing by the second distance, each conductive element comprising an end disposed within a cavity of the second column.

18. The electrical connector of claim 17, wherein the at least one first projection comprises a ridge along the first surface extending from a first end of the first column to a second, opposite end of the first column.

19. A daughter card connector adapted to mate with a backplane connector, the daughter card connector comprising:

an insertion end constructed and arranged to mate with a receiving portion of the backplane connector;

a surface having a protrusion disposed at a middle region of the surface offset from the insertion end, the surface having a mating direction, the protrusion being elongated in a direction substantially perpendicular to the mating direction; and a plurality of mating contacts disposed adjacent to the surface, the mating contacts being constructed and arranged such that a middle portion of each mating contact is spaced from the protrusion when the daughter card and the backplane connector are unmated and presses against the protrusion upon mating of the insertion end with the receiving portion such that a force exists between middle portions of the mating contacts.

20. The connector of claim 19, wherein the protrusion comprises a substantially half-cylindrical shape.

21. The connector of claim 20, wherein the protrusion has a radius of curvature.

22. The connector of claim 19, wherein the protrusion is offset from the insertion end.

23. The connector of claim 19, wherein the protrusion extends a distance above the shaft.

24. The connector of claim 19, wherein the surface comprises a portion of a front housing having cavities, each cavity constructed and arranged to receive an end of one mating contact.

25. The connector of claim 19, wherein ends of the mating contacts have curved contact regions, the contact regions facing away from the surface.

* * * * *